US006203473B1

(12) United States Patent
Atwood

(10) Patent No.: US 6,203,473 B1
(45) Date of Patent: Mar. 20, 2001

(54) STRETCHING AND EXERCISE APPARATUS

(75) Inventor: Duncan F. Atwood, Seattle, WA (US)

(73) Assignee: PearTree Systems, Inc., Seattle, WA (US)

( * ) Notice: Subject to any disclaimer, the term of this patent is extended or adjusted under 35 U.S.C. 154(b) by 0 days.

(21) Appl. No.: 09/064,708

(22) Filed: Apr. 22, 1998

Related U.S. Application Data

(60) Provisional application No. 60/044,391, filed on Apr. 23, 1997.

(51) Int. Cl.[7] ..... A63B 21/00

(52) U.S. Cl. ..... 482/95; 482/46; 482/142; 482/148; 482/907

(58) Field of Search ..... 482/142, 148, 482/145, 907, 95, 96, 38, 41; 606/240, 241, 237

(56) References Cited

U.S. PATENT DOCUMENTS 3,739,793 * 6/1973 Wilson .
4,102,336 * 7/1978 Wiener .
5,492,520 * 2/1996 Brown ..... 482/140
5,697,874 * 12/1997 Abelbeck ..... 482/140
5,728,035 * 3/1998 Sands ..... 482/140
5,813,957 * 9/1998 Rossiter ..... 482/140
5,842,960 * 12/1998 Yu ..... 482/131

* cited by examiner

*Primary Examiner*—Danton D. DeMille
*Assistant Examiner*—William LaMarca
(74) *Attorney, Agent, or Firm*—Christensen O'Connor Johnson Kindness PLLC

(57) ABSTRACT

A stretching and exercise apparatus (10) includes a pair of parallel legs (11*a,* 11*b*) having first ends and second ends. The first ends of the legs define arcuate rocker portions (12*a,* 12*b*) having straight distal ends (22*a,* 22*b*). A top crosspiece (16) is secured transversely across the legs is attached. The apparatus further includes a pair of handgrips (20*a,* 20*b*) that extend generally perpendicularly from the legs pointing in the same direction as the straight distal ends. Optionally, a lower crosspiece (18) may be provided across the legs in parallel with the top crosspiece. Preferably, the top crosspiece is pivotally attached to the legs for selective angular adjustment, and the handgrips and the lower crosspiece are slidably attached to the legs for selective longitudinal positioning. The axis of rotation of the rocker portions closely coincides with the pivot axis of a person's hip joint. The apparatus is used to provide support, control, and leverage during various stretching exercises.

24 Claims, 12 Drawing Sheets

STRETCHING AND EXERCISE APPARATUS

CROSS-REFERENCE TO RELATED APPLICATION

The present application claims the benefit under 35 U.S.C. §119(e) of U.S. provisional application Ser. No. 60/044,391, filed Apr. 23, 1997 now abandoned.

FIELD OF THE INVENTION

The present invention relates to a stretching and exercise apparatus, and more particularly to a portable and multipositionable apparatus for assisting a person in stretching and exercising by providing leverage and stability during various stretching and strengthening exercises. A user can stretch and exercise all muscle groups and associated structures using this apparatus.

BACKGROUND OF THE INVENTION

Stretching as part of an exercise program is widely accepted by health professionals, physical trainers, and coaches, as a way to prepare for physical activity and to gain range of motion lost due to inactivity, disease, aging, unbalanced training, and so on. Regular stretching of the body muscles increases or maintains both the flexibility and range of motion of the joints. This can result in both the muscles and associated structures being more able to withstand sudden movements and more biomechanically correct movement patterns being permitted, which, by themselves, can significantly reduce the occurrence of injury. One example of this last point is in the case of lower back injuries, which often result from poor lifting technique. However, poor lifting technique is often the result of the individual being too inflexible to squat down sufficiently low. Such an individual must round the back to lift things, which is a widely acknowledged position of risk for incurring lower back injuries.

To help remedy this situation, the muscles must be stretched properly to avoid injury during the stretching exercise itself. Application of too much force too fast can cause injury; it is preferable to approach the range-of-motion limit gradually and apply just enough force to accurately position the body segment to be stretched. Moreover, the ideal way to stretch muscles is while the muscles are in a relaxed state, thereby maximizing the range of motion of the joint while minimizing the likelihood of a muscle pull or other injury.

However, it is difficult for an individual to apply a gradual, static stretch to muscles, especially the larger muscles of the legs, for example, the hamstring muscles. One common manner of stretching the hamstring muscles is to lie in a supine position with the leg to be stretched raised up in the air and the other leg on the floor. Then, either the exerciser, him- or herself, pulls the raised leg forwardly toward his or her head by grasping the back of the thigh with the hands, or a second individual pushes against the raised leg. As can be appreciated, it is difficult for either the exerciser or the assistant to accurately position and then hold the leg. Either the exerciser cannot relax due to the effort required to stabilize the leg and actuate the stretch, or the stability and actuation efforts provided by the partner, which permit the exerciser to relax, cannot provide the exact positioning required for an efficient stretch, since the assistant cannot know what the exerciser is feeling. A convenient, safe, and affordable aid to performing this maneuver can help inflexible individuals gain or maintain flexibility to help prevent injuries.

Various tubular frame apparatus have been developed for performing strength-building floor exercises, that is, exercises performed while moving about a floor with the apparatus providing assistance. Since stretching is traditionally performed on a floor, it is often erroneously included in this group of strength building exercises. However, stretching is a distinctly different activity since the limit of position of the body segment is the determining factor, not the load or cumulative work, as is the case with strength-building exercises. Therefore, apparatus designed for strengthening alone seldom possess the features needed to address the determining factors in stretching, namely, allowing for body segment relaxation, a low strength requirement during use, and leverage to allow easily achieved positioning. One such type of strengthening apparatus utilizes a tubular frame with one or more crosspiece elements, where various body segments can be positioned and the motion thereof resisted by other body segments. Examples of this type of apparatus are disclosed by U.S. Pat. Nos. 3,540,724 and 3,920,240. This type of apparatus has the inherent disadvantage of not allowing a mechanical advantage of the kind to apply leveraged, gradually applicable forces to body segments stabilized by the apparatus itself. Because of this, such apparatus do not permit the kind of relaxation desired for proper stretching. The degree of athleticism required to operate such apparatus, due to their lack of the aforementioned features, limits their use to only already physically fit individuals.

In another class of apparatus, bent metal tubing is used to create a frame for the exercising of leg muscles. Examples of this type of apparatus are disclosed by U.S. Pat. Nos. 2,644,688 and 5,236,333. Drawbacks of these particular kinds of apparatus include the requirement that the user be seated in a chair to operate them, and that they are limited in their application to exercising certain leg muscle groups only.

Prior to the present invention, the inventor has been awarded U.S. Pat. No. 5,122,106 for a stretching apparatus. While well suited to its intended purpose, it has certain limitations in the mass consumer and medical markets due to complexity and cost of construction, floor space and volume required for storage, and specialty of function.

SUMMARY OF THE INVENTION

To address the above-discussed limitations of prior art apparatus, the present invention provides an apparatus for stretching body muscles in an improved, safer, and more biomechanically acceptable manner. As such, the present invention allows stretching in a less physically demanding, and easy-to-learn manner. In addition, simple strength-building exercises, using the user's body weight for resistance may also be performed with the present invention. Further, the apparatus of the present invention is inexpensive to construct, and easy to transport or store.

The present invention provides a stretching and exercising apparatus that includes a pair of legs extending generally in parallel with, and being spaced apart from, each other. The legs have first ends and second ends. The first ends of the legs define arcuate rocker portions having straight distal ends that are oriented generally orthogonally relative to a plane defined by the legs. The second ends of the legs are attached by a first crosspiece, extending transversely across and between the legs. The apparatus further includes a pair of handgrips that extend generally perpendicularly from the legs, approximately midway between the second ends and the rocker portions of the legs. The handgrips are oriented generally orthogonal to the plane defined by the legs, and thus extend generally in the same direction as the straight distal ends. A second crosspiece may also be attached transverse across the legs, in parallel with the first crosspiece at a longitudinal orientation spaced between the second ends and the handgrips. Preferably, the first crosspiece is selectively pivotally attached to the legs, and the lower crosspiece and the handgrips are slidably attached to the legs. The first crosspiece and the second crosspiece are used to receive various body parts during different stretching and exercise activities and, thus, are preferably covered with elastomeric pads for the user's comfort. The rocker portions and the handgrips may be covered with high-friction sleeves to prevent slippage.

In another embodiment, a stretching and exercising apparatus includes parallel legs having first and second ends, a top crosspiece, a pair of handgrips, and an optional lower crosspiece, as in the first embodiment. Unlike the first embodiment, the first ends of the legs are pivotally supported on a pair of ground-engaging stands, instead of defining arcuate rocker portions, to facilitate gradual tilting movement of the legs.

In yet another embodiment, a stretching and flexibility training apparatus of the present invention includes a pair of generally S-shaped serpentine legs spaced apart from each other in parallel. The legs have first ends and second ends. As in the first embodiment, the first ends define a pair of arcuate rocker portions that include straight distal ends, and the second ends are connected with a top crosspiece oriented perpendicularly to the legs. The legs further include a curved or bent portion, approximately halfway between the second ends and the rocker portions, for being grasped by a person. Thus, this embodiment does not include a separate set of handgrips; instead handgrips are integrally formed with the legs. Optionally, a lower crosspiece is provided in parallel with the top crosspiece, perpendicularly across the legs, as in the first embodiment.

In the present invention, the arcs defined by the arcuate rocker portions have a predetermined radius such that the pivot axis of the apparatus as it pivots on the arcuate rocker portions closely coincides with the hip pivot axis of an average person lying in a supine position. This feature, together with the straight distal ends, allows, for example, a supine hamstring stretch to be performed with maximum control, stability, and comfort, because the limb to be stretched is held in a stable fashion.

Further, the rocker portions of the present invention provide a mechanical advantage of applying leveraged, gradually applicable force to a body segment stabilized by the apparatus itself. Specifically, the rocker portions permit exact positioning of the apparatus during different stretching exercises. As can be appreciated, as a body segment moves to near the limit of its range of motion, the difference in position between a productive stretch and a damaging one becomes only a few degrees of joint angle. The rocker portions of the present invention, in combination with the leverage provided by the legs, the crosspieces, and the handgrips, allow an infinitely adjustable and easily achievable level of stretch amplitude. The rocker portions permit a smooth, controlled rocking action as the legs are tipped in one direction. This action permits the top and lower crosspieces to rise or lower, relative to the floor, to further provide enough stability to aid in the balance of an individual performing an exercise.

In the present invention, the entire stretching and exercising apparatus and, therefore, the pivot axis of the apparatus, may be quickly and easily adjusted according to the size or need of a user. The apparatus also provides for subtly (i.e., in fine increments) and precisely adjusting the location of the top and lower crosspieces according to a user's leg length or other requirement, and a user's preferred amount of knee flexion (for locating the greatest feeling of stretch in different portions of the muscle or other requirement). For the purpose of quick and easy repositioning of the apparatus for different exercises, the overall weight of the apparatus, and the number of adjustments that need to be made to the apparatus for each exercise, are kept to a minimum. This feature, by not requiring time-consuming and confusing mechanical adjustments, as required for more complex mechanical apparatus, makes it easier for a user to comply with prescribed regimens of stretching. With the adjustability feature, the apparatus (and therefore the limb position of a user) may be maintained at a predetermined desired angular position without imparting further tension on the limb to be stretched, which adds a measure of safety to a stretching regime.

In another aspect of the invention, the apparatus is designed to stand upright on its straight distal ends of the rocker portions, stably and freely without support, so as to provide balance assistance to users performing those standing stretches and exercises that require either a stable handgrip or a horizontal bar such as a ballet bar. This horizontal bar support is provided by the top and lower crosspieces of the present apparatus, which are padded to minimize discomfort and to minimize slippage of the user's feet or hands during use. Furthermore, the rocker portions may be covered with rubber sleeves to prevent the apparatus from slipping when in contact with the floor or with the user's hands or feet.

In a first preferred embodiment of the present invention, the handgrips are mounted perpendicularly to the legs to minimize uncomfortable and possibly injurious wrist action during use. The post-style handgrips, as embodied in the present invention, are desirable because they can be gripped comfortably by the user in many different planes. Rubber sleeves may be provided on the handgrips to further minimize the user's effort required to maintain positions. Another factor in the activity of stretching is the considerable strength needed to effectively stretch even midsize muscles. Grip strength is important, as is the strength necessary to put the muscles to be stretched under sufficient tension to produce a usable result. The present invention addresses these problems by providing handgrips of such a configuration and location, covered with grip-enhancing sleeves, that the requirements of grip strength are minimized. Leverage provided by the present invention's frame geometry further reduces the strength requirements for stretching by amplifying power applied to the handgrips.

Additionally, the stability provided to the body segments to be stretched by the present invention enhances relaxation of the muscles to be stretched. For example, when an exerciser is lying down with his, or her, leg raised up in the air, an effort is expended to keep the leg from falling off to one side or the other. This effort significantly impacts the exerciser's ability to relax, and therefore properly stretch, the hamstring muscles targeted to be stretched by this position. The present invention allows the exerciser to completely relax the upraised leg in this example and, thus, allows safer and lower effort stretching to occur.

Lastly, the apparatus of the present invention is inexpensive to construct, and can be disassembled or folded for easy transportation and storage.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENTS

Figure 1:
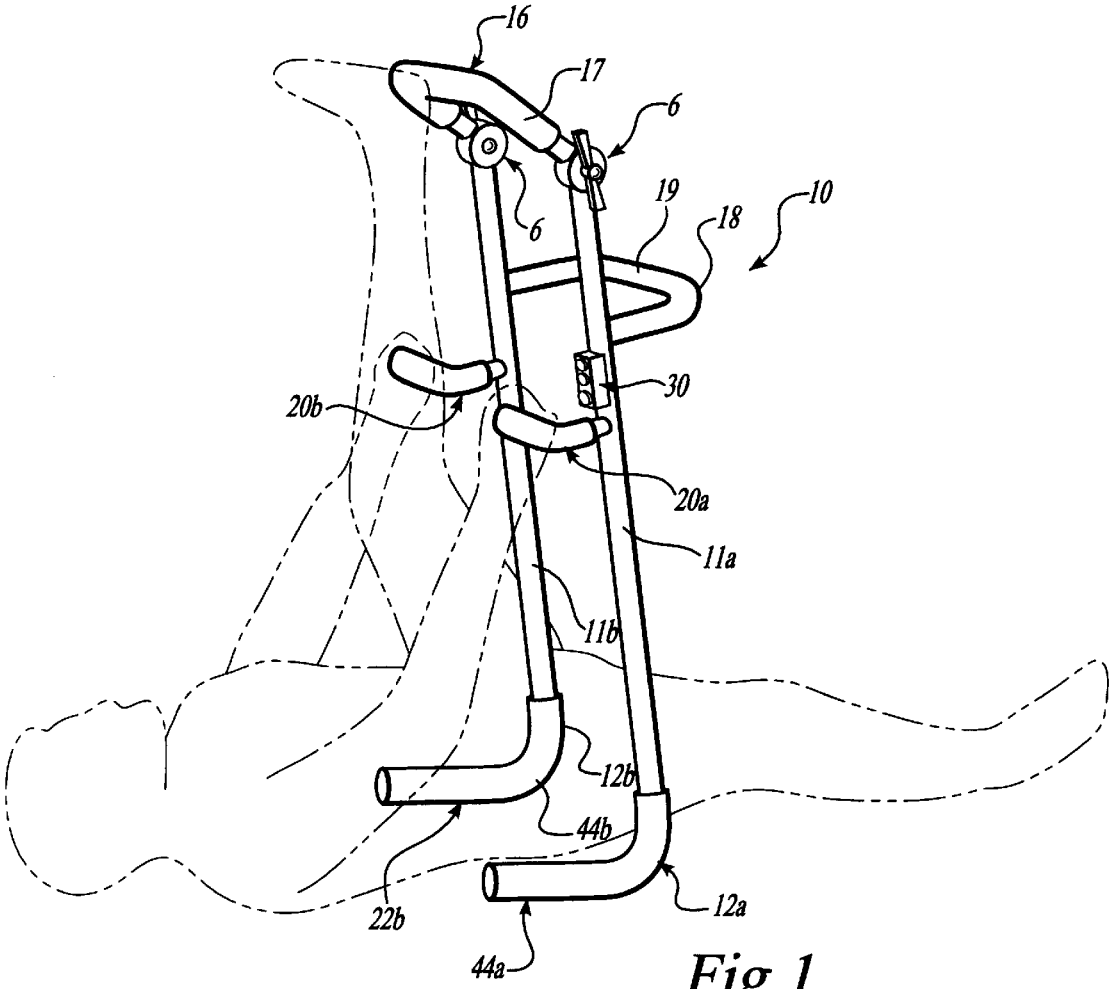
FIG. 1 is a general isometric view of a stretching and exercise apparatus of the present invention, in use by a person in a supine position for a hamstring and calf stretch.

Referring initially to FIG. 1, a stretching and exercise apparatus 10 of the present invention is illustrated as being utilized by an individual disposed in a supine position. The apparatus 10 includes a pair of legs, 11*a* and 11*b*, extending in parallel with, and being spaced apart from, each other. The legs have first ends and second ends. The first ends of the legs define arcuate rocker portions, 12*a* and 12*b*, having straight distal ends, 22*a* and 22*b*, respectively. The second ends of the legs are connected with a U-shaped top crosspiece 16 having a center section that is oriented perpendicularly across the legs. The apparatus further includes a pair of handgrips, 20*a* and 20*b*, extending generally perpendicularly from the legs, 11*a* and 11*b*, respectively, approximately midway between the second ends and the rocker portions 12*a*, 12*b*. The handgrips 20*a*, 20*b* are oriented generally orthogonal to a plane that includes the legs 11*a*, 11*b* and the top crosspiece 16 (when positioned in line with the legs), and are pointing generally in the same direction as the straight distal ends 22*a*, 22*b*. Optionally, a U-shaped lower crosspiece 18 may be attached perpendicularly to the legs 11*a*, 11*b*, in parallel with the top crosspiece 16, between the second ends and the handgrips 20*a*, 20*b*. Preferably, the legs 11*a*, 11*b*, the top crosspiece 16, the handgrips 20*a*, 20*b*, and the lower crosspiece 18 are constructed from tubular material, such as aluminum or steel, for convenience of manufacture and sufficient structural integrity without undue weight. However, it is to be understood that these members may be composed of other types of material without departing from the spirit of the present invention.

The tubular legs 11*a*, 11*b* as shown in FIG. 1 stand vertically on the two parallel straight distal ends 22*a*, 22*b* without support. To assist in ensuring stability, the top crosspiece 16 is suitably bent "forward" with respect to the legs 11*a*, 11*b* to produce a center of gravity roughly centered in the base of the apparatus 10 between the rocker portions 12*a*, 12*b*. As used herein, the term "forward" indicates the direction in which the handgrips 20*a*, 20*b* and the straight distal ends 22*a*, 22*b* point, and the term "rearward" indicates the opposite direction. It will be appreciated that stabilization of the legs 11*a*, 11*b* may be accomplished in other ways without departing from the spirit of the present invention, for example, by varying the weight or relative location of each component of the apparatus 10.

The rocker portions 12*a*, 12*b* are formed in arcs having a radius of approximately 3 inches measured from a central axis of the tube forming the rocker portion. The legs, 11*a* and 11*b*, and the straight distal ends, 22*a* and 22*b*, respectively, form an included angle of approximately 60° to less than 90°, and more preferably 60° to 80° for receiving the rocker portions, 12*a* and 12*b*, respectively. Preferably, the rocker portions 12*a*, 12*b* are covered with high-friction sleeves 44*a*, 44*b*, such as rubber sleeves, to prevent slippage of the apparatus 10 during various exercises. The high-friction sleeves 44*a*, 44*b* may further include raised ridges or grooves on their surfaces to enhance their gripping power.

Figure 2A:
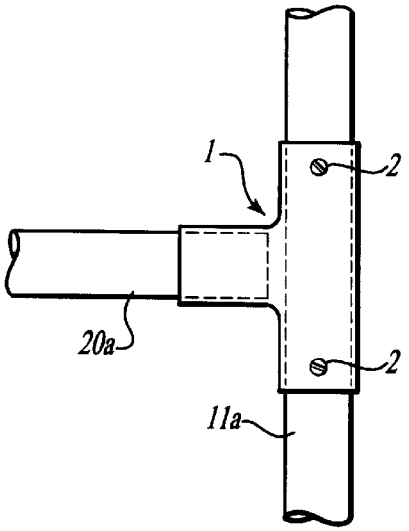
FIGS. 2A and 2B are a side view and a front plan view, respectively, of a tubular T-connector for joining the handgrips to the legs of the apparatus of FIG. 1, with the handgrip shown only partially for clarity, such T-connector also suitably used for connection of the lower crosspiece.
Figure 2B:
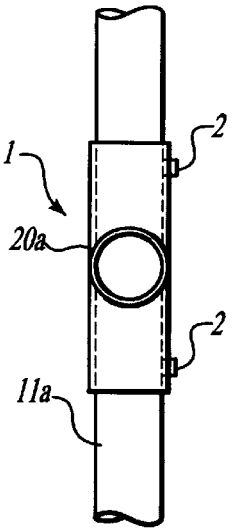

The handgrips, 20*a* and 20*b*, are attached to the legs, 11*a* and 11*b*, respectively, approximately halfway between the second ends of the legs and the rocker portions 12*a*, 12*b* of the legs 11*a*, 11*b*. The handgrips 20*a*, 20*b* project "forwardly" and perpendicularly to the legs 11*a*, 11*b*. The handgrips 20*a*, 20*b* may each be either an integral part of the legs 11*a*, 11*b*, formed in a semicircle or other bent form, or a separately formed part that is attached to the legs 11*a*, 11*b*. In the latter case, a tubular T-connector 1, illustrated in detail in FIGS. 2A and 2B, may be used to adjustably attach the longitudinal positioning of each of the handgrips 20*a*, 20*b* to each of the legs 11*a*, 11*b*. FIGS. 2A and 2B are a front view and an end view, respectively, of the T-connector 1. Though FIGS. 2A and 2B illustrate attachment of the handgrip 20*a* to the leg 11*a*, it should be understood that the handgrip 20*b* is attached to the leg 11*b* in the same manner. Referring to FIGS. 2A and 2B, the T-connector 1 includes two set screws 2, and permits adjusting the locations of the handgrip 20*a* on the leg 11*a* to better suit the limb length of the user. To adjust handgrip locations, first, the set screws 2 are loosened on the T-connector. The T-connector 1, to which the handgrip 20*a* is securely attached, is then slid along the leg 11*a* to a preferred position. Finally, the set screws 2 are retightened to secure the handgrip 20*a* at a new location. Adjustability of handgrip locations is desirable to avoid undue strain on the user and to accommodate various limb lengths of potential users. For the comfort of the user, and to further minimize hand strength requirements of the user, the handgrips 20*a*, 20*b* are covered with high-friction sleeves made of a grip-enhancing material such as rubber, as is well-known in the art. The high-friction sleeves may further include raised ridges or grooves on their surfaces to enhance their gripping power, as previously described with respect to the sleeves for the rocker portions.

The lower crosspiece 18 provides support and stabilization for various body parts, and can be made either fixed or adjustable. In the latter case, the lower crosspiece 18 may be attached to the legs 11*a*, 11*b* using a T-connector as described above. By sliding T-connectors, the longitudinal location of the lower crosspiece 18 on the legs 11*a*, 11*b* may be selectively adjusted to fit the height of a user. The range of adjustment for the lower crosspiece 18 along the legs 11*a*, 11*b* is between roughly four inches away from the second ends of the legs 11*a*, 11*b* and the handgrips 20*a*, 20*b*, for a total distance of about eight inches. While it is preferred that the handgrips 20*a*, 20*b* and lower crosspiece 18 be adjustably secured, it is to be understood that rigid securement is also within the scope of the present invention.

When the lower crosspiece 18 is of a generally flat U shape, as in FIG. 1, the center of the lower crosspiece 18 is oriented transversely and perpendicularly to the legs 11*a*, 11*b*, and is attached to their "rear" sides, i.e., the sides opposite the sides to which the handgrips 20*a*, 20*b* are attached. Preferably, the lower crosspiece 18 extends "rearwardly" from the legs 11*a*, 11*b* by about six inches. Further, the lower crosspiece 18 is preferably covered with a pad 19 made of expanded closed-cell foam, as well known in the art, to permit comfort during use. The pad 19 may cover the entire lower crosspiece 18 or only a portion thereof.

Instead of a T-connector, a clamping hinge, as more fully described below, may be used to attach the lower crosspiece 18 to the legs 11*a*, 11*b*. In this case, the position of the lower crosspiece 18 is adjusted pivotally. A clamping hinge, however, is less desirable as an attachment means due to the difficulty of padding the hinge area and also because its pivotal adjustment of the lower crosspiece 18 causes the lower crosspiece 18 to be at a varying distance from the legs 11*a*, 11*b*.

Figure 3A:
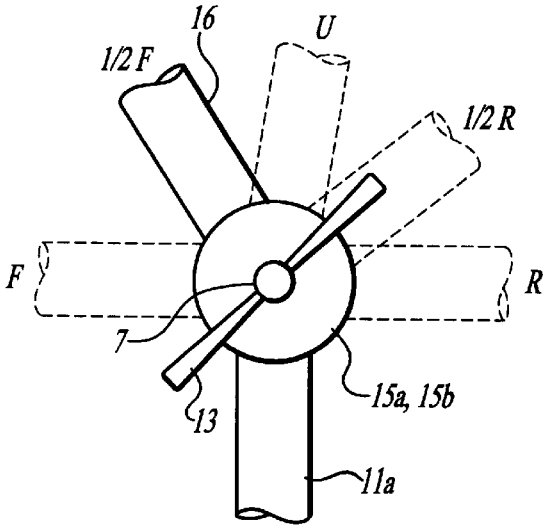
FIGS. 3A and 3B are a side view and a front plan view, respectively, of a clamping hinge for adjustably Joining the top crosspiece to the legs of the apparatus of FIG. 1.
Figure 3B:
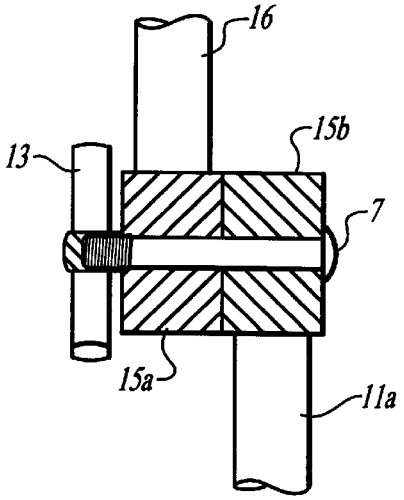

The top crosspiece 16, connected to the second ends of the legs 11*a*, 11*b*, serves to provide stability and leverage to the user. A pad 17, similar to the pad 19 of the lower crosspiece 18, may be used to cover all or a portion of the top crosspiece 16 for the user's comfort. A clamping hinge 6 may be used to pivotally attach the top crosspiece 16 to the second ends of the legs 11*a*, 11*b* for selective angular adjustment. FIGS. 3A and 3B, which are a side view and a front view, respectively, of a clamping hinge 6 in detail, illustrate that the clamping hinge 6 allows the top crosspiece 16 to be pivotally displaced among various positions with respect to the leg 11*a*. The possible positions include: forward "F", half forward "½ F", upward "U", half rearward "½ R", and rearward "R". It should be understood that a clamping hinge to be attached to the other leg 11*b* to hold the other end of the top crosspiece 16 operates in a similar manner.

Referring to FIGS. 3A and 3B, the clamping hinge 6 includes a bolt 7, a wing nut 13 or thumbscrew, and a pair of overlapping disks 15*a*, 15*b*. To change the pivotal orientation of the top crosspiece 16 with respect to the leg 11*a*, the wing nut 13 is loosened from the bolt 7 to allow the disks 15*a* and 15*b* to rotate about the bolt 11. The disks 15*a*, 15*b* may be designed to be especially slip resistant on their contacting faces by having a textured, studded, starburst, or other grip-enhancing surface. After the wing nut 13 is loosened, the top crosspiece 16 may be pivotally adjusted to the desired location. The wing nut 13 is then firmly tightened, to compress the disks 15*a*, 15*b* against each other to prevent displacement of the top crosspiece 16, although locking mechanisms, such as a cam lever lock, could be utilized.

In the alternative, a slidable detent and spring button arrangement could be utilized to attach the top crosspiece 16 to the legs 11*a*, 11*b*. This alternative, however, would not offer the variability of pivotal positioning, forward and rearward, of the top crosspiece 16. The forward and rearward pivotal variability greatly increases the movement possibilities afforded by the present invention. Pivotal adjustability of the top crosspiece 16 further allows the apparatus 10 to be reconfigured for different exercises and to be disassembled or folded for easy transportation and storage.

Figure 4A:
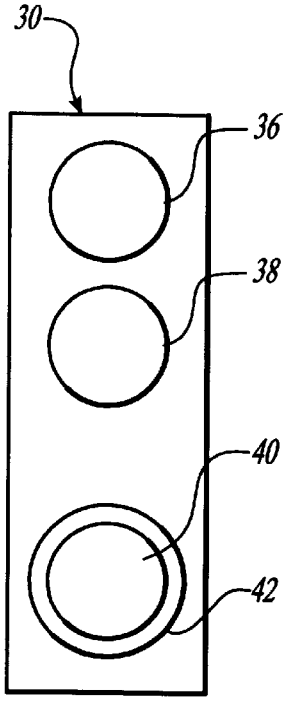
FIGS. 4A and 4B are a front plan view and a side view, respectively, of a countdown timer suitable for attachment to the apparatus of FIG. 1.
Figure 4B:
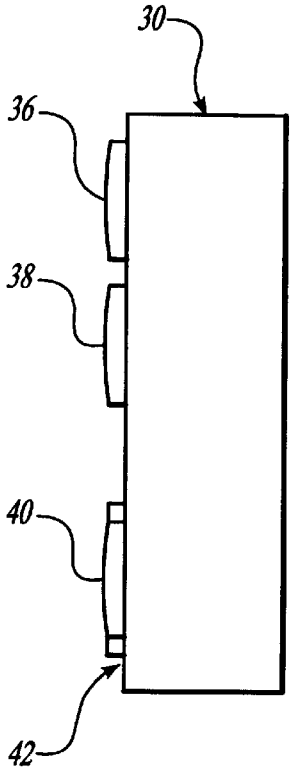

The apparatus 10 may further include a timer 30 to aid the user of the apparatus 10 in following stretching protocols. FIGS. 4A and 4B are a front view and an end view, respectively, of the timer 30. The timer 30 includes a 10-second button 36, a 30-second button 38, a stop button 40 and a raised ring 42 that surrounds the stop button 40. Other predetermined time periods may be utilized. A specific method of constructing such a timer is well known in the art and, thus, is outside the scope of this invention. When the 10-second button 36 is pressed, a brief signal tone to signal initiation of the 10-second countdown mode is emitted, and the timer 30 provides a brief tone every 10 seconds. When the 30-second button 38 is pressed, a double tone is emitted to signal initiation of the 30-second countdown mode, and the timer 30 provides double tones every 30 seconds. Various other time interval arrangements are possible. In either countdown mode, the timer 30 continues to operate until the stop button 40 is pressed. The raised ring 42 encircling the stop button 40 allows the user to distinguish the stop button 40 from the 10-second and 30-second buttons 36, 38 by feel only. This configuration is preferable since the user may not always be positioned to look at the timer 30. The timer 30, by measuring the time period for each stretching exercise and exercise interval, allows the user to concentrate on the, activity being-performed without having to count or guess at how much time has passed.

Figure 5C:
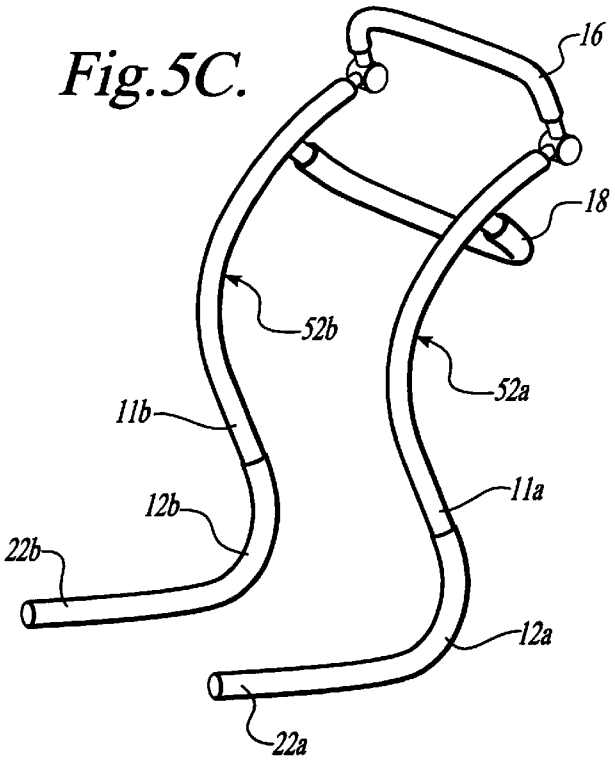
FIGS. 5A, 5B, and 5C show examples of first, second, and third alternate embodiments of the present invention.
Figure 5B:
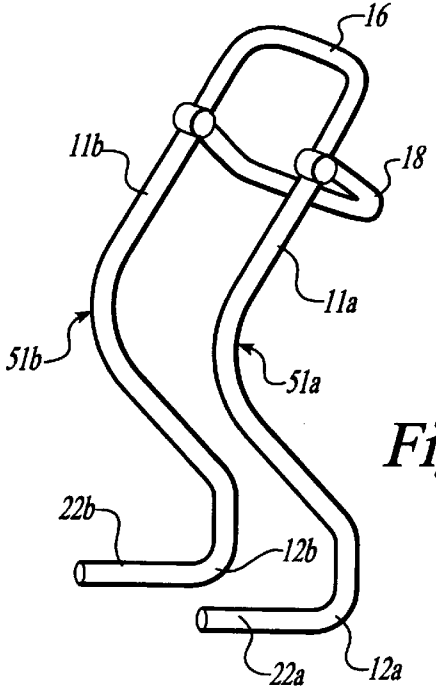
Figure 5A:
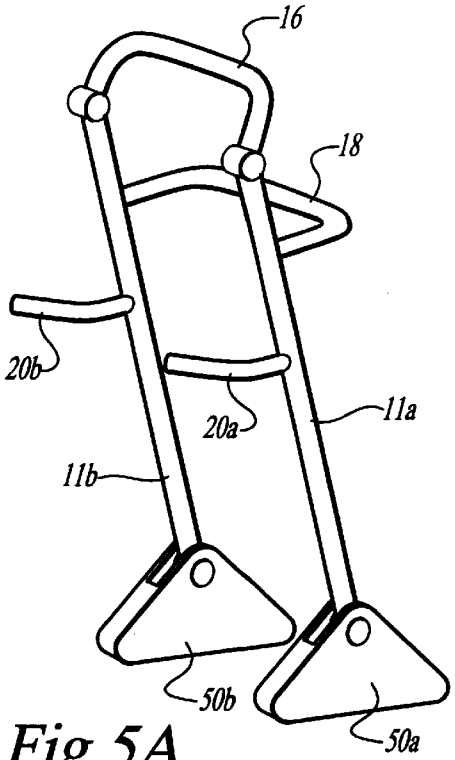

FIGS. 5A, 5B and 5C illustrate examples of alternative embodiments of the present invention. FIG. 5A illustrates a stretching and exercising apparatus that includes, as the first embodiment described above, a pair of parallel legs 11*a*, 11*b*, having first ends and second ends, a top crosspiece 16 connected to the second ends of the legs 11*a*, 11*b*, a lower crosspiece 18, and a pair of handgrips 20*a*, 20*b*. A difference from the first embodiment lies in that the first ends of the legs 11*a*, 11*b* are pivotally supported by a pair of stands, 50*a* and 50*b*, respectively. Though the stands 50*a*, 50*b* are illustrated as having a triangular shape, in FIG. 5A, the configuration of the stand is not limited to this specific example. This embodiment of the apparatus, however, is less desirable than the first embodiment because this embodiment will be more expensive to manufacture, and will not serve as many functions, because the stands 50*a*, 50*b* cannot be used as handgrips.

FIGS. 5B and SC illustrate yet another embodiment that differs from the first embodiment of the present invention in that handgrips are integrally formed with the legs of the apparatus. The apparatus includes generally S-shaped parallel legs, 11*a* and 11*b*, having first ends and second ends. The first ends, as in the first embodiment, define arcuate rocker portions 11*a*, 11*b* having straight distal ends 22*a*, 22*b* on which the apparatus may stand. The legs 11*a*, 11*b*, unlike in the first embodiment, further include bent portions 51*a*, 51*b* in FIG. 5B, or curved portions 52*a*, 52*b* in FIG. 5C, approximately halfway between the second ends and the rocker portions 12*a*, 12*b* of the legs 11*a*, 11*b*, for being grasped by a person. The bent or curved portions, 51*a* and 51*b*, or, 52*a* and 52*b*, thus serve as handgrips. The second ends of the legs 11*a*, 11*b* are attached to a top crosspiece 16 which is oriented perpendicularly to the legs 11*a*, 11*b*. As illustrated in FIG. 5B, the top crosspiece 16 may be formed integrally with the legs 11*a*, 11*b*. Finally, a lower crosspiece 18 may be attached to the legs 11*a*, 11*b*, as in the first embodiment of the present invention.

DESCRIPTION OF OPERATION

FIG. 1 shows how the apparatus 10 may be used to stretch the hamstring and calf muscles of a selected leg. The apparatus 10 is disposed vertically on the rocker portions 12*a*, 12*b*, with the handgrips 20*a* and 20*b* directed toward the head of a user. The user lies supine with his or her hip joints substantially aligned with the pivot axis of the rocker portions 12*a*, 12. Adjustment of the upper crosspiece 16 is done to suit the leg length and ability level of the user; FIG. 1 shows an adjustment generally suited to users of average leg length and ability. Adjustment of the lower crosspiece 18 is not critical. Grasping the handgrips 20*a*, 20*b*, the user places the heel of the foot of the leg to be stretched on the upper crosspiece 16 and pulls the handgrips 20*a*, 20*b* to effect a stretch while rocking the apparatus 10 on the rocker portions 12*a*, 12*b*. The leverage, grip enhancement, and side-to-side stability offered by the apparatus 10, together with the pivoting action of the rockers 12*a*, 12*b*, which maintains alignment with the user's hip pivot axis during the rocking motion, provide a smooth, low-effort, controllable and easily maintained stretch.

Adjustment of the apparatus 10 is carried out as follows. First, the user determines the desired orientation of the top crosspiece 16, and the desired positioning of the lower crosspiece 18 within the legs 11*a*, 11*b*, according to the exercise to be performed. Then the user loosens the wing nut 13 of the clamping hinge 6 provided on each side of the apparatus 10 to allow the top crosspiece 16 to be pivoted to the desired angular orientation. The wing nut 13 is then retightened on each side to secure the top crosspiece 16 to the legs 11*a*, 11*b*. To slidably adjust the location of the lower crosspiece 18, set screws 2 for each T-connector 1 holding the lower crosspiece 18 are loosened. Once the lower crosspiece 18 is moved to a preferred location, the set screws 2 are retightened. Additionally, the handgrips 20*a*, 20*b* may be slidably adjusted in the same manner as the lower crosspiece 18. The user will either consult an accompanying instruction booklet, labels depicting exercises affixed to the apparatus 10, or receive instructions from a medical practitioner, for proper use of the apparatus 10.

To provide examples of various stretching and strengthening exercises that may be performed using the present invention, reference is made to FIGS. 6 through 51. It is to be understood that these exercises are not all inclusive, and that many others are possible and desirable. Since adjustment of the handgrips 20*a*, 20*b* is generally made only once upon each user's initial fitting to the apparatus 10, no mention is made of such adjustment in the following descriptions. Similarly, the lower crosspiece 18 and upper crosspiece 16 are not always adjusted for each exercise and thus are mentioned only as appropriate.

Figure 6:
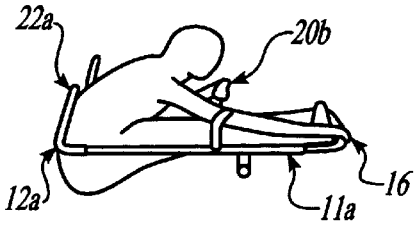
FIGS. 6–51 schematically illustrate various representative of additional exercises that may be performed using the first embodiment of the present invention.

FIG. 6 shows a well-known stretch for the hamstrings. The user positions the apparatus 10 parallel to the floor, with the straight distal ends 22*a*, 22*b* pointing upward, and seats him- or herself on the floor with the hips sandwiched between the rocker portions 12*a*, 12*b* and one leg extended along and between the legs 11*a*, 11*b*. The top crosspiece 16 is adjusted upward. The lower crosspiece 18 can be in any position. The foot of the extended leg is braced against the top crosspiece 16. With the other knee flexed, the user reaches toward the top crosspiece 16 as far as needed to provide a sensation of stretch in the posterior portion of the extended leg, while grasping the legs 11*a*, 11*b*, or the handgrips 20*a*, 20*b*, whichever is convenient. The apparatus 10 offers advantages of positioning several body parts at once to ensure correct form, while providing convenient and easily maintained grip positions for the hands.

Figure 7A:
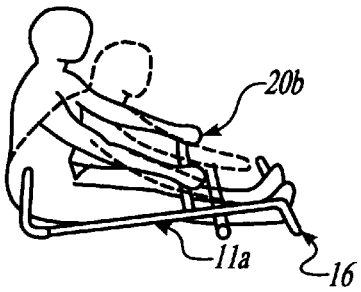
Figure 7B:
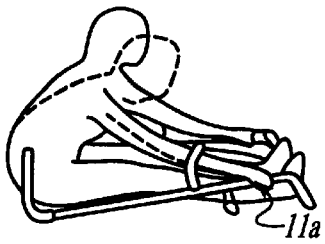

FIGS. 7A and 7B show how the apparatus 10 may be used to perform the sit-and-reach flexibility test; a commonly used test to evaluate the flexibility of the lower back and posterior leg muscles. The top crosspiece 16 is adjusted half rearward. Adjustment of the lower crosspiece 18 is not critical. The user positions the apparatus 10 parallel to the floor and sits within the apparatus with the feet braced against the top crosspiece 16. The user selects one of the three main possible hand positions (with other hand positions being possible as desired for a given activity): on the handgrips 20*a*, 20*b*; along the legs 11*a*, 11*b*; or on the top crosspiece 16, as illustrated in FIGS. 7A, 7B, and 6, respectively, according to the user's flexibility level.

Figure 8:
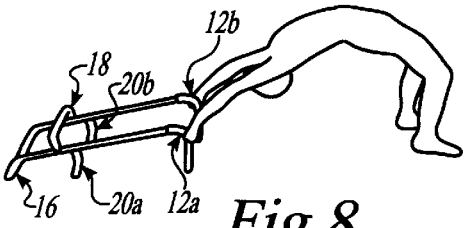

FIG. 8 shows how the apparatus 10 may be used for a common stretch used in sports to improve flexibility for the extension of the spine from lumbar to cervical curves. The user positions the apparatus parallel to the floor with the handgrips 20*a*, 20*b* pointing toward the floor. The top crosspiece 16 is adjusted half forward. Adjustment of the lower crosspiece 18 is not critical. The user, lying supine with the head near the rocker portions 12*a*, 12*b* of the apparatus 10, reaches backward to grip the rocker portions 12*a*, 12*b*. From that position the user extends the body into a bow position. The apparatus makes the exercise easier for beginners because the user gripping the rocker portions 12*a*, 12*b* is able to start the lift with his, or her, hands approximately 12 inches above the floor. With this position, less shoulder flexibility and thoracic flexibility are required to achieve a comfortable extension of the spine. The rocker portions 12*a*, 12*b* also make the stretch easier because the user is able to select optimal hand positions that require less wrist extension. This feature is not available to a person performing the stretch on the floor without the apparatus. As the user's flexibility and strength improve, the user is able to change the emphasis of the stretch by positioning the rocker portions 12*a*, 12*b* closer to the shoulder joint, and lowering the hand positions toward the floor until the hands can be placed directly on the floor.

Figure 9:
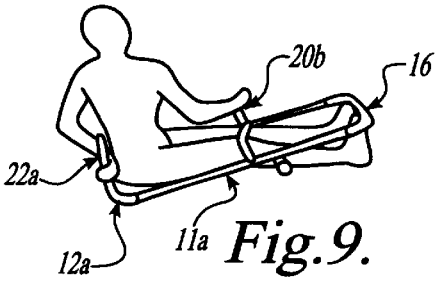

FIG. 9 shows how the apparatus 10 may be used to perform a seated trunk rotation stretch. The user positions the apparatus parallel to the floor, with the straight distal ends 22*a*, 22*b* pointing upward, and seats him- or herself on the floor with the hips between the rocker portions 12*a*, 12*b* and with both legs extended along and between the legs 11*a*, 11*b*. The top crosspiece 16 is adjusted upward. Adjustment of the lower crosspiece 18 is not critical. Bracing the balls of the feet against the top crosspiece 16 effects a stretch in the posterior muscles of the legs. Referring specifically to FIG. 9, one hand grips an opposite-side handgrip 20*b*, while the other hand reaches behind the body to grip the straight distal end 22*a* of the rocker portion 12*a* that lies diagonally from the gripped handgrip 20*b*. In this position the user is able to pull the spine into proper vertical alignment and rotational movement, by using the grips and the bracing action of the feet against the top crosspiece 16.

Figure 10:
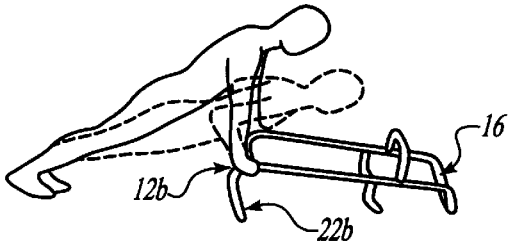

FIG. 10 shows how the apparatus 10 may be used to perform a traditional pushup. The user positions the apparatus 10 parallel to the floor with the straight distal ends 22*a*, 22*b* in contact with the floor. The top crosspiece 16 is adjusted either fully or halfway forward. The user then assumes the beginning position with arms extended and hands grasping the rocker portions 12*a*, 12*b*. The user then lowers the body until the upper arms become parallel to the floor. The apparatus positions the user in such a manner that the user can maintain a flat back throughout the exercise, which is a preferred position because it lessens the strain on the lower back due to hyperextension (a common fault with traditional pushups). The user is also assisted by the grasping action, since placement of the hands on the rocker portions 12*a*, 12*b* provides a grasp that is less stressful on the wrist joint than the traditional hyperextended wrist position associated with pushups performed on the floor. Another effect of using the apparatus for pushups is that the elevated starting position shifts the body's center of gravity farther away from the hands and toward the feet.

Figure 11:
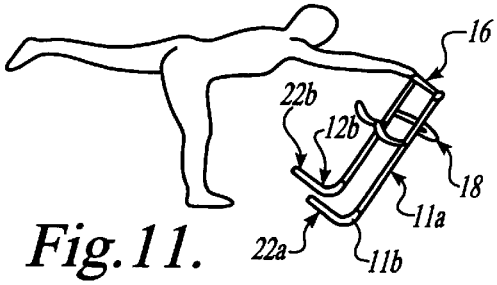

FIG. 11 shows the user in a classic yoga pose. The apparatus 10 is positioned vertical to the floor on the rocker portions 12*a*, 12*b*, with the straight distal ends 22*a*, 22*b* directed at the user. The user is standing on one leg while extending the other leg horizontally rearward, and using the hands to grasp the top crosspiece 16 which has been adjusted forward. Adjustment of the lower crosspiece 18 is not critical. With the top crosspiece 16 adjusted in this manner, the center of gravity is preserved during the different phases of the pose. Specifically, the rocking action of the apparatus 10 counterbalances the raising of the leg so that the center of gravity is maintained within the tripod formed by the rocker portions 12*a*, 12*b* and the foot the user is standing on. The apparatus, thus acting as a balance aid, allows this yoga exercise to be practiced more easily and safely by beginners.

FIGS. 12A, 12B, 12C, and 12D show the apparatus 10 disposed vertically on the rocker portions 12*a*, 12*b*, with the handgrips 20*a*, 20*b* facing a standing user. The top crosspiece 16 is adjusted forward. Adjustment of the lower crosspiece 18 is not critical. For FIG. 12B, while grasping the top crosspiece 16 with both hands, the user steps forward to FIG. 12C with one leg and lowers the body until the rear knee touches the floor in a lunge maneuver. The user may also step rearward from FIG. 12B to the position shown in FIG. 12A. The apparatus 10 provides side-to-side support to the user by virtue of the spacing between the rockers 12*a* and 12*b*. In addition, the leg strength demands of this exercise are significantly reduced because of the support provided by the apparatus 10 to the arms of the user. Further, the rocker portions 12*a*, 12*b* allow the legs 11*a*, 11*b* and the top crosspiece 16 to move in an arc, thereby providing support to the user during all phases of the exercise. These features allow better technique and improved safety to both beginners and experts.

Figure 12A:
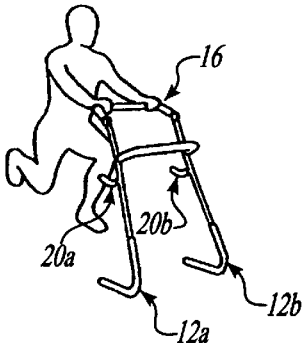
Figure 12B:
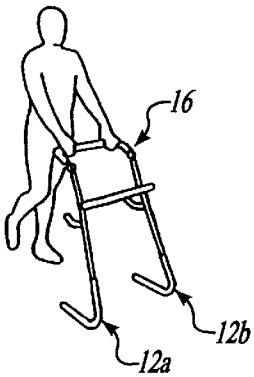
Figure 12C:
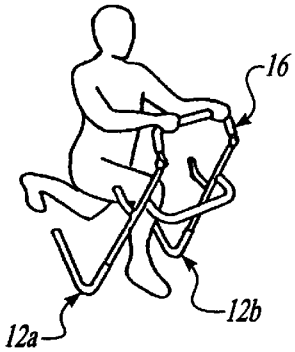
Figure 12C:
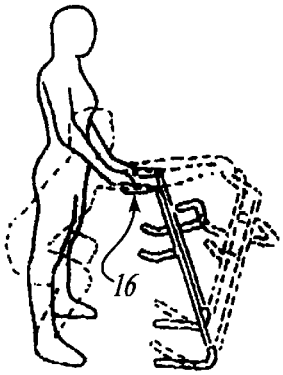

Referring to FIG. 12D, positioning and adjustment aspects of the apparatus remain the same as in FIG. 12A, but the action of the squatting exercise of FIG. 12D differs as follows: instead of stepping forward, the standing exerciser squats downward until his or her thighs are parallel to the ground. Lateral support is not as important as for the lunge but the support of the arms in preventing excessive forward lean is a more significant feature in avoiding lower back strain. Additionally, the user is able to significantly assist the motion of rising from the lowest point of the exercise by pushing downward on the top crosspiece 16.

Figure 13:
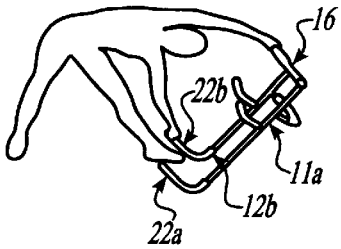

FIG. 13 shows the user in a classic yoga pose. The apparatus 10 is positioned vertical to the floor on the rocker portions 12*a*, 12*b*, with the straight distal ends 22*a*, 22*b* directed at the user. The user is standing in a stride position with the foot of a forward leg positioned between the rocker portions 12*a*, 12*b* next to one of them, for example, the rocker portion 12*b* in FIG. 13, with the ball of the foot located approximately at the pivot axis of the rocker portions 12*a*, 12*b*. The ipsilateral hand of the forward leg is grasping the straight distal end 22*b* of the rocker portion 12*b* next to which the forward foot is placed. The other hand is grasping the top crosspiece 16 which has been adjusted forward. With the top crosspiece 16 adjusted in this manner, the center of gravity is preserved along and over the axis of rotation of the rocker portions 12*a*, 12*b* during the different phases of the pose. The particular manner in which the balance and support are supplied lessens the strain on the lower back.

Figure 14:
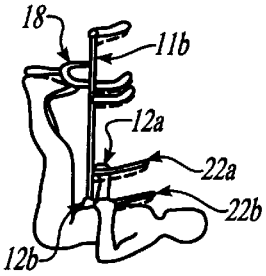

FIG. 14 shows how the apparatus 10 may be used to effect a stretch in the posterior calf muscles. The apparatus 10 is positioned vertical on the rocker portions 12*a*, 12*b*, with the straight distal ends 22*a*, 22*b* directed toward the head of a user lying in a supine position. Adjustment of either crosspiece, 16 or 18, is not critical. The user lies between the legs 11*a*, 11*b*, with the hips approximately aligned with the pivoting axis of the rocker portions 12*a*, 12*b*. The user then places the balls of the feet on the lower crosspiece 18 and, while grasping the rocker portions 12*a*, 12*b*, lifts the apparatus 10 off the floor. The user then pulls down on the rocker portions 12*a*, 12*b* to effect a stretch in the posterior lower leg muscles.

Figure 15:
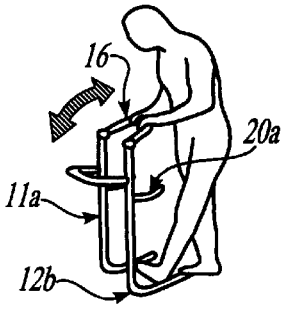

FIG. 15 shows how the apparatus 10 may effect a highly leveraged stretch of the foot and calf muscles. The apparatus 10 is disposed vertically on the rocker portions 12*a*, 12*b*, with the handgrips 20*a*, 20*b* directed at the user. The top crosspiece 16 is adjusted half forward. Adjustment of the lower crosspiece 18 is not critical. While standing and facing the apparatus 10, the user wedges his or her foot in the angle formed by the rocker, 12*a* or 12*b*, (depending upon which foot and calf the user wishes to stretch) in such a manner as to extend the toe of the foot. The user then pulls the top crosspiece 16 toward him or her to deepen the stretch. This method of calf and foot stretch affords the user a low muscular-strength method of obtaining an easily metered-out level of stretch. The leverage provided by the apparatus 10, in combination with the rocking action of the rocker portions 12*a*, 12*b*, allows an easily achieved and maintained calf and foot stretch.

Figure 16:
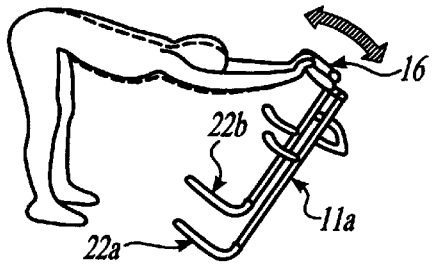

FIG. 16 shows how the apparatus 10 may be used to effect a stretch of the shoulders, hamstrings, and torso. The apparatus 10 is positioned vertical to the floor on the rocker portions 12*a*, 12*b*, with the straight distal ends 22*a*, 22*b* directed at the user. The top crosspiece 16 is adjusted forward. The adjustment of the lower crosspiece 18 is not critical. The user is positioned with the feet hip-width apart, with the knees slightly or more bent to focus the stretch away from the posterior leg muscles to the shoulder muscles. The user grasping the top crosspiece 16 rocks the legs 11*a*, 11*b* away from the initial vertical position to the position allowing for a moderate stretch of the shoulders. With the top crosspiece 16 adjusted forward, the center of gravity is preserved along and over the axis of rotation of the rocker portions 12*a*, 12*b* during the different phases of the pose. The particular manner in which the balance and support are supplied lessens the strain on the lower back.

Figure 17:
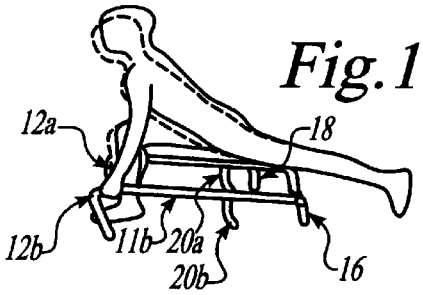

FIG. 17 shows how the apparatus 10 may be used to effect a stretch of the hip flexor muscles. The legs 11*a*, 11*b* are positioned parallel to the floor, with the handgrips 20*a*, 20*b* facing downward, and the top crosspiece 16 adjusted forward. Adjustment of the lower crosspiece 18 is not critical. The user stands between the rocker portions 12*a*, 12*b* with toes pointing away from the top crosspiece 16. The user then reaches down with the hands to grasp the rocker portions 12*a*, 12*b*, while extending a chosen leg toward the lower crosspiece 18. The user then rests the anterior portion of the extended thigh on the lower crosspiece 18 while maintaining an extended spine, and flexes the forward hip and knee to effect the stretch. The apparatus 10 allows this stretch to be performed without its usual problems: wrist hyperextension, lower back loading and rounding, and undesirable levels of forward hip and knee flexion.

Figure 18:
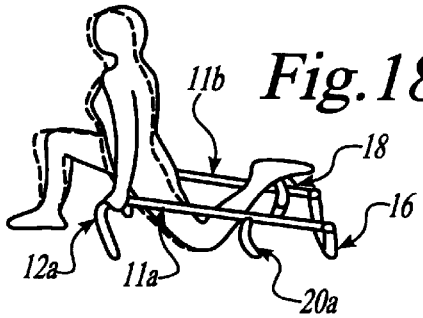

FIG. 18 shows how the apparatus 10 may be used to effect a stretch of the quadriceps and hip flexor muscles. The legs 11*a*, 11*b* are positioned parallel to the floor, with the handgrips 20*a*, 20*b* facing downward and the top crosspiece 16 adjusted forward. The lower crosspiece 18 is adjusted toward the top crosspiece 16 for a beginner, and away from the top crosspiece 16 for an advanced user. The user stands between the rocker portions 12*a*, 12*b* with toes pointing away from the top crosspiece 16. The user then reaches down with the hands to grasp the rocker portions 12*a*, 12*b* while extending a chosen leg toward the lower crosspiece 18. The knee of the extended leg is flexed and rested upon the floor, while the top of the foot of the same leg rests against the lower crosspiece 18. In this position the apparatus 10 provides side-to-side stability to the user. The lower crosspiece 18 braces the user's rear leg in a position of knee flexion, which, when combined with the hip and back extension made possible by the hand position elevated from the floor as the user grasps the legs 11*a*, 11*b*, effects a stretch on the quadriceps and hip flexor muscles.

Figure 19:
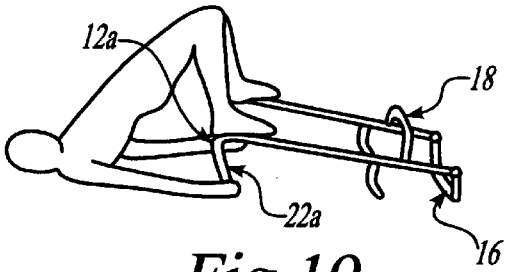

FIG. 19 shows how the apparatus 10 may be used to perform a modified yoga pose. The apparatus 10 is positioned parallel to the floor with the straight distal ends 22*a*, 22*b* in contact with the floor. The top crosspiece 16 is positioned forward. Adjustment of the lower crosspiece 18 is not critical. The user lies supine with the arms extended along the sides of the body. The user then grasps the straight distal ends 22*a*, 2*b* of the rocker portions 12*a*, 12*b* and raises his feet onto the top of the rocker portions 12*a*, 12*b*, one foot at a time. The user then lifts the hips and torso off the floor while keeping the upper legs from abducting. With the aid of the apparatus 10, a less flexible beginner (tight in the quadriceps and hip flexors) is able to do an inverted pose.

Figure 20A:
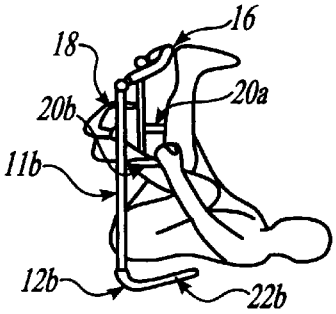
Figure 20B:
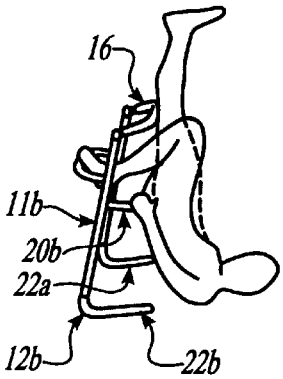

FIGS. 20A and 20B show, sequentially, how the apparatus 10 may be used to assist in an inverted shoulder stand pose. The top crosspiece 16 is adjusted to the half forward position according to the leg length of a user. The lower crosspiece 18 is adjusted away from the top crosspiece 16 for shorter users, and toward the top crosspiece 16 for taller users. The apparatus 10 is positioned vertically on the rocker portions 12*a*, 12*b*, with the straight distal ends 22*a*, 22*b* directed toward the head of a user. The user is positioned supine between the legs 11*a*, 11*b* with the hips aligned with the pivoting axis of the rocker portions 12*a* and 12*b*. The user grasps the handgrips 20*a*, 20*b* as one foot is raised and the ball of that foot is placed on the lower crosspiece 18. The other leg is lifted and the heel is placed in contact with the forward surface of the top crosspiece 16. From this position, the user gradually rocks the apparatus 10 forward on the rocker portions 12*a*, 12*b* to provide assistance in lifting one or both legs to a vertical position so as to have the backs of the knees in contact with the top crosspiece 16. The rocking motion, occurring because of the pull with the hands on the handgrips 20*a*, 20*b* and the bracing of the lower leg against the lower crosspiece 18, assists the user in raising the hips and shifting the center of gravity from the abdomen to the upper chest. This allows the weight of the body to be borne primarily by the shoulders and thoracic spine rather than the cervical spine. The apparatus 10 allows the user to return to a sitting position in a carefully controlled descent so as not to hyperextend the lumbar spine. To return to the starting position the user lowers one leg to the lower crosspiece 18. Then, while moving the extended leg slightly away from the top crosspiece 16 and bracing the foot of the lowered leg on the lower crosspiece 18, the user lowers the hips and allows the legs 11*a*, 11*b* to rock rearward on its rocker portions 12*a*, 12*b*. The user tucks the head forward to round the spine and finish the rocking motion to a sitting position.

Figure 21:
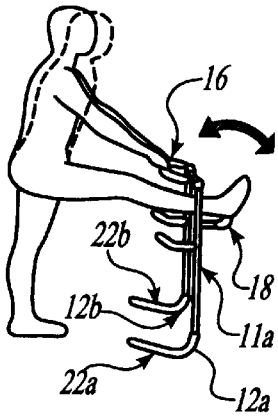

FIG. 21 shows how the apparatus 10 may be used to do a standing hamstring stretch. The apparatus 10 is positioned vertical to the floor on the rocker portions 12*a*, 12*b*, with the straight distal ends 22*a* and 22*b* directed toward the user. The top crosspiece 16 is adjusted forward to be approximately level with the hip joint. The lower crosspiece 18 is adjusted away from the top crosspiece 16 for a tight user, and toward the top crosspiece 16 for a flexible user. The user grasps the top crosspiece 16 with both hands and then rocks the apparatus 10 away from the user as the user lifts one knee and extends the leg to place the heel on the lower crosspiece 18. The tripod formed by the rocker portions 12*a*, 12*b* and the foot that the user is standing upon, as well as the user's grasp of the top crosspiece 16, is a balance aid that allows this exercise to be practiced more easily and safely by beginners. In addition, the rocking motion of the rocker portions 12*a*, 12*b*, initiated by the push or pull of the hands on the top crosspiece 16 to move the legs 11*a*, 11*b* toward or away from the body, allows the user to subtly position the apparatus 10 to vary the stretch of the leg.

Figure 22:
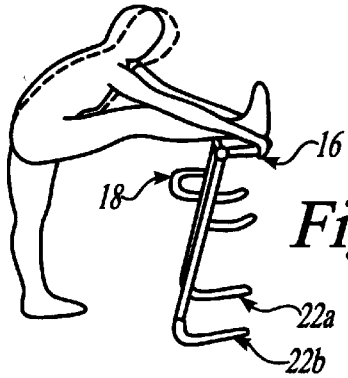

FIG. 22 shows how the apparatus 10 may be used to do an advanced standing hamstring stretch. The apparatus 10 is positioned vertical to the floor on the rocker portions 12*a*, 12*b*, with the straight distal ends 22*a*, 22*b* directed away from the user. The top crosspiece 16 is adjusted to be approximately level with the hip joint of the standing user. Adjustment of the lower crosspiece 18 is not critical. The user grasps the top crosspiece 16 with both hands and then rocks the apparatus 10 away from the user, as the user lifts one knee and extends the leg to place the heel on the top crosspiece 16. The action of the apparatus 10 is virtually the same as the action described with respect to FIG. 21. The apparatus 10 functions in the same manner so as to provide balance in the stretching exercise. The subtle positioning of the apparatus 10 allows advanced users to receive the same stability and support that beginners in FIG. 21 receive using the apparatus 10.

Figure 23:
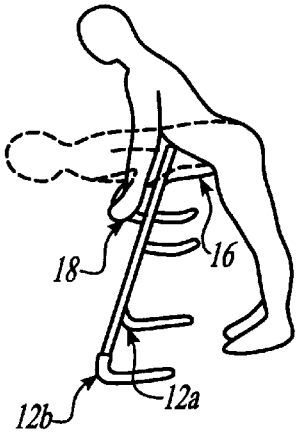

FIG. 23 shows how the apparatus 10 may be used to do a back extension exercise. The apparatus 10 is positioned vertical to the floor on the rocker portions 12*a*, 12*b*, with the straight distal ends 22*a*, 22*b* facing toward the standing user. The top crosspiece 16 is adjusted to be approximately level with the hip joint. The lower crosspiece 18 is adjusted to provide easy reach for the user. The user positions the apparatus 10 so that the top crosspiece 16 is against the hip joints. This position of the top crosspiece 16 provides pelvic stability. The user grasps the lower crosspiece 18, and extends the spine into erect alignment while assisting this motion by extending the elbows. The amount of assistance provided by the arms may vary according to the fitness level of the user.

Figure 24:
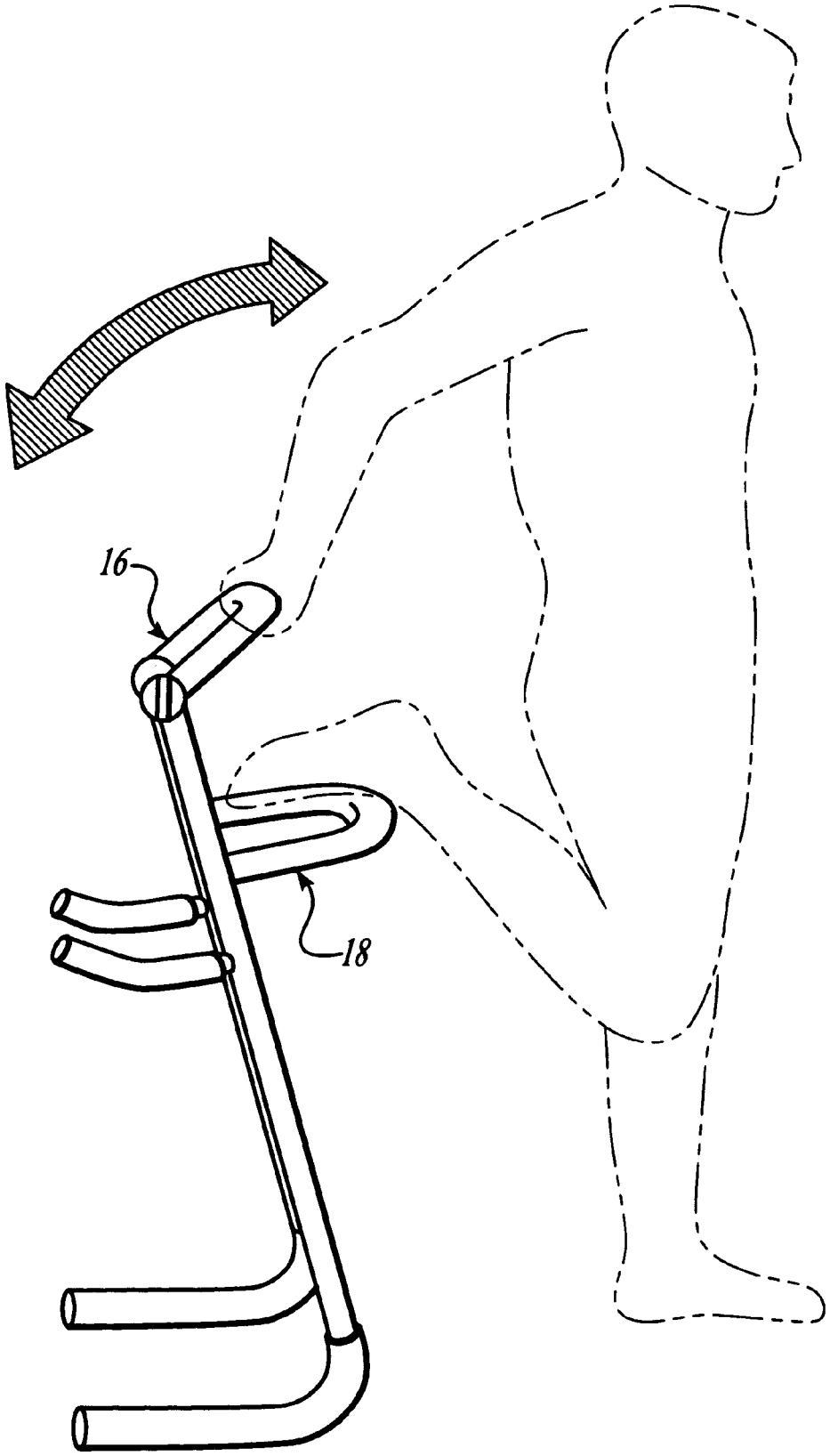

FIG. 24 shows how the apparatus 10 may be used to effect a standing quadriceps stretch. The apparatus 10 is positioned vertical to the floor on the rocker portions 12*a*, 12*b*, and the user is standing on the rearward side of the apparatus 10 facing away from the apparatus 10. The top crosspiece 16 is adjusted half rearward to provide a handgrip for the user. The lower crosspiece 18 is adjusted to the height of or below the standing user's hip joint level. While standing on one foot, the user flexes the knee of the leg to be stretched and places the top of the ankle onto the lower crosspiece 18. The user then rocks the apparatus 10 to further flex the knee, thereby imparting a stretch to the quadriceps muscles of the chosen leg. Using the apparatus 10 for this stretch, as opposed to an unassisted stretch of this configuration, lessens the strain on the shoulder and the requirements for grip strength and balance, and permits greater control in flexing the knee.

Figure 25:
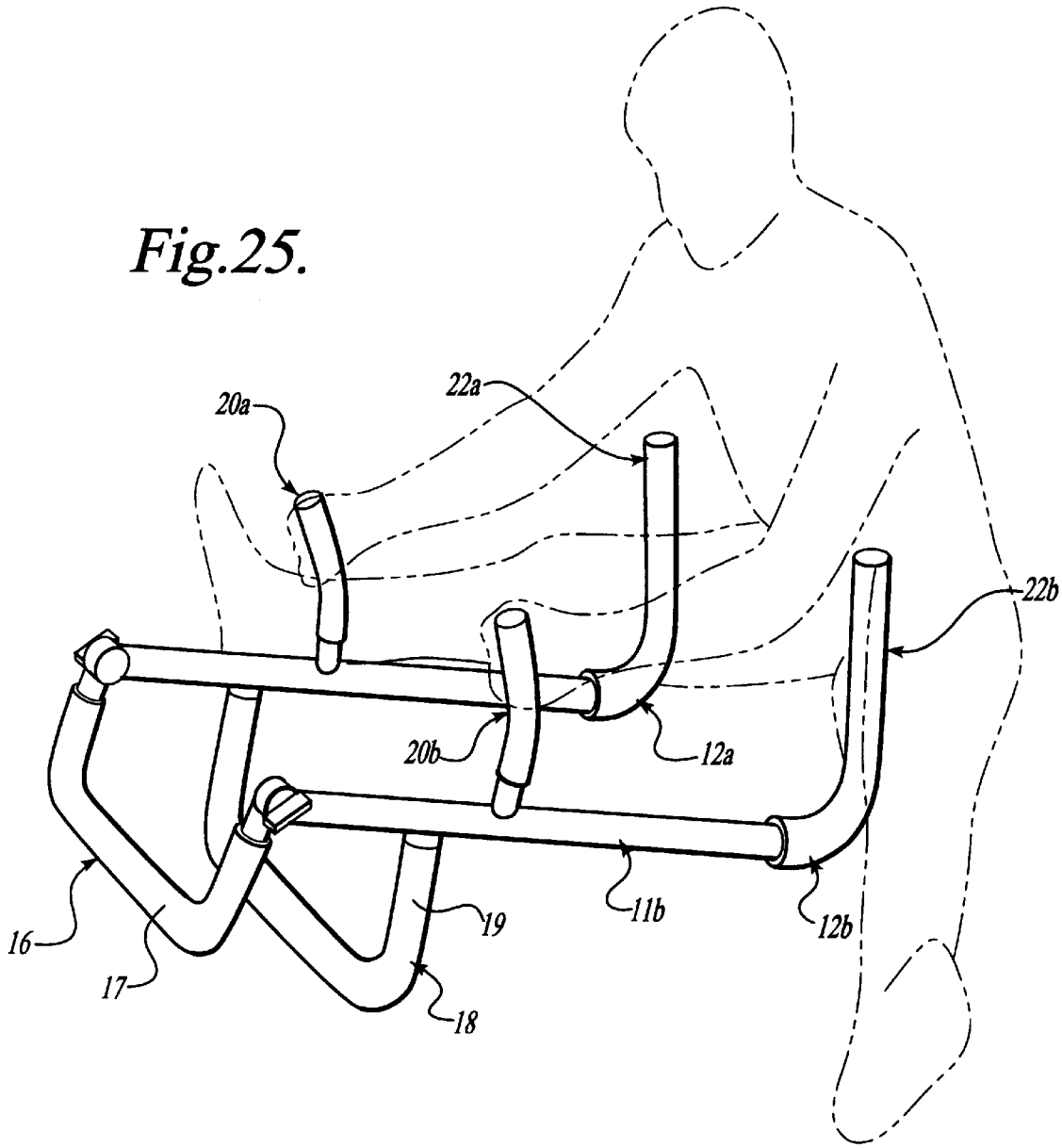

FIG. 25 shows how the apparatus 10 may be used to effect a stretch of the hip adductors, hamstrings, and lower back muscles. The apparatus 10 is positioned parallel to the floor with the handgrips 20*a* and 20*b* facing upward. Adjustment of either crosspiece, 16 or 18, is not required. The user sits spread-legged, or straddled, with the straight distal ends 22*a*, 22*b* placed against the inner thighs. The user may grasp either the handgrips 20*a*, 20*b*, or the legs 11*a*, 11*b* anywhere along their length, to effect the desired stretch. The variance of hand position allows the user to select the desired degree of stretch.

Figure 26:
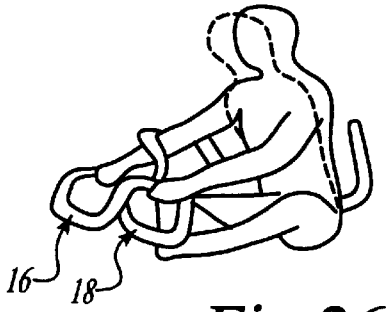

FIG. 26 shows how the apparatus 10 may be used to effect a stretch of the hip adductors in a targeted fashion. Adjustment of either crosspiece, 16 or 18, is not required. The apparatus 10 is positioned parallel to the floor with the handgrips 20*a*, 20*b* facing upward. Each of the legs 11*a*, 11*b* is positioned on each thigh of the user to assist in lowering the thighs to the floor. The user may brace his or her feet against the lower crosspiece 18 to stabilize the apparatus 10. The user may grasp either the handgrips 20*a*, 20*b*, or the legs 11*a*, 11*b* anywhere along their length, to effect the desired stretch. The variance of hand position allows the user to select the desired degree of stretch. This allows the user to more easily maintain the correct form required to effect a safe and useful stretch than in unassisted free stretching.

Figure 27:
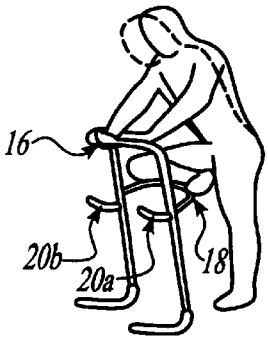

FIG. 27 shows how the apparatus 10 may be used to effect a stretch of the hip internal rotator muscles. The apparatus 10 is positioned vertical to the floor on the rocker portions 12*a*, 12*b*, with the handgrips 20*a*, 20*b* facing away from the standing user. The top crosspiece 16 is adjusted half forward. The lower crosspiece 18 is adjusted to the height of or below the standing user's hip joint level. The user stands facing the apparatus 10 with the hands grasping the top crosspiece 16. The user then flexes the knee of the leg to be stretched, and flexes and externally rotates the hip of the chosen leg to place the ankle and knee of said leg upon the lower crosspiece 18. This position allows greater control over the degree and location of a stretch than the traditional method of stretching the same muscles.

Figure 28:
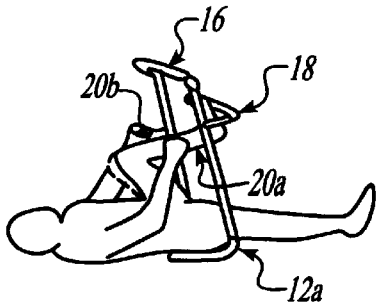

FIG. 28 shows how the apparatus 10 may be used to stretch the upper posterior thigh and lower back muscles. The apparatus 10 is disposed vertically on the rocker portions 12*a*, 12*b*, with the handgrips 20*a*, 20*b* directed toward the head of a user. The user lies supine with his or her hip joints substantially aligned with the pivot axis of the rocker portions 12*a*, 12*b*. Adjustment of either crosspiece, 16 or 18, is not critical. Grasping the handgrips 20*a*, 20*b*, the user places the foot of the leg to be stretched against the inner surface of the lower crosspiece 18 and pulls on the handgrips 20*a*, 20*b* to effect a stretch while rocking the apparatus 10 on the rocker portions 12*a*, 12*b*. The leverage and grip enhancement provided by the apparatus 10, together with the arcing rocker motion, provide a smooth, low-effort, and easily maintainable stretch.

Figure 29:
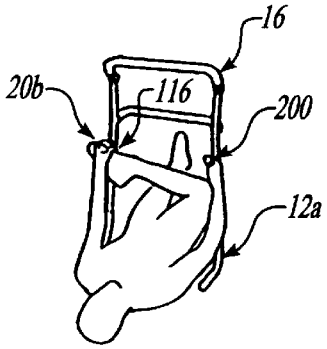

FIG. 29 shows how the apparatus 10 may be used to stretch the piriformis muscle. The apparatus 10 is positioned as in FIG. 28. The user is positioned within apparatus 10 as shown in FIG. 28. Adjustment of either crosspiece, 16 or 18, is not critical. Grasping the handgrips 20*a*, 20*b*, the user bends his knee and places his foot against the opposing, forward surface of the leg 11*b* and pulls on said handgrips to effect a stretch by way of the rocking action of the rocker portions 12*a*, 12*b*. The leverage and grip enhancement provided by the apparatus 10, along with the arcing rocker action, provide a smooth, low-effort and easily maintainable stretch.

Figure 30:
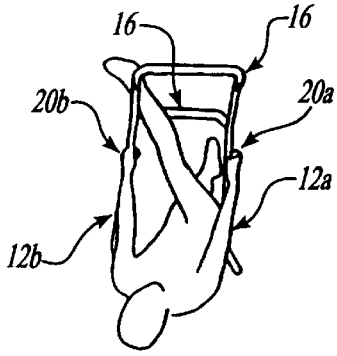

FIG. 30 shows how the apparatus 10 may be used to stretch the illiotibial band. The apparatus 10 is disposed vertically and askew to the user with the handgrips 20*a*, 20*b* directed forward. The user is supine with his hip joint substantially aligned with the pivot axis of the rocker portions 12*a*, 12*b*. Adjustment of the top crosspiece 16 is not critical. Grasping the handgrips 20*a*, 20*b*, the user places his straight leg against the inner side of the lower crosspiece 18 to effect a stretch by way of the rocking action of the rocker portions 12*a*, 12*b*. The leverage and grip enhancement provided by the apparatus 10, along with the arcing rocker action, provide a smooth, low-effort and easily maintainable stretch.

Figure 31A:
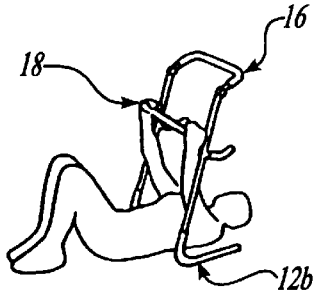
Figure 31B:
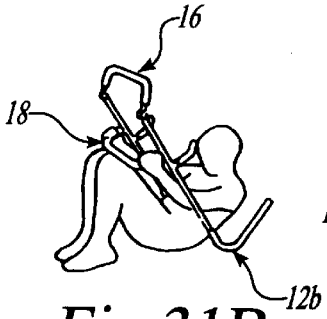

FIG. 31A and FIG. 31B show how the apparatus 10 may be used to strengthen the abdominal muscles. The apparatus 10 is positioned as in FIG. 28. The user is positioned within the apparatus 10 with the rocker portions 12*a*, 12*b* substantially aligning with the user's upper back. Adjustment of the top crosspiece 16 is not critical. Grasping the outer edge of the lower crosspiece 18, the user effects the exercise by lifting his head, neck, and shoulders off the floor while pulling down and rearward on the lower crosspiece 18, activating the rocking motion of the rocker portions 12*a*, 12*b* until the lower crosspiece 18 contacts the user's thighs (FIG. 31B). The arcing rocker action of the apparatus 10 and the leverage provided by the lower crosspiece 18 provide a smooth, assisted exercise for strengthening the abdominal muscles.

Figure 32:
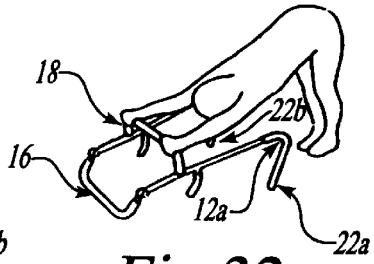

FIG. 32 shows how to do an exercise common to yoga using the apparatus 10. The user positions the apparatus 10 parallel to the floor with the straight distal ends 22*a*, 22*b* in contact with the floor. The top crosspiece 16 is adjusted halfway forward. Standing within the rocker portions 12*a*, 12*b*, facing the lower crosspiece 18, the user bends over to grasp the lower crosspiece 18 with his hands a shoulder's width apart. The user steps backwards, placing feet together, and lifting hips into a pike position. The elevated hand placement and grip enhancement provided by the apparatus 10 lessens the extreme stretch on the hamstrings encountered when performing this move unassisted. The mechanics of the grip allow for a stronger push into the position and lessen the risk of wrist strain encountered when performing this move unassisted.

Figure 33:
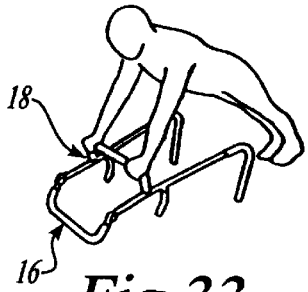

FIG. 33 shows how to do an exercise common to yoga. The apparatus 10 is positioned as in FIG. 32. The top crosspiece 16 is adjusted halfway forward. Standing within the rocker portions 12*a*, 12*b*, facing the lower crosspiece 18, the user bends over and grasps the lower crosspiece 18 with his hands a shoulder's width apart. The user steps backwards, placing feet together, and pushing heels back assuming a pushup position. The elevated hand placement and grip enhancement provided by the apparatus 10 provide a less extreme position for doing this exercise.

Figure 34:
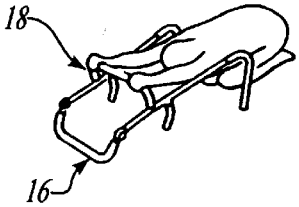

FIG. 34 shows how the apparatus 10 may be used to do an exercise common to yoga. The apparatus 10 is positioned as in FIG. 32. The top crosspiece 16 is adjusted halfway forward. Facing the lower crosspiece 18, the user kneels an arm's length away from the lower crosspiece 18 and grasps the lower crosspiece 18. The user then lowers himself onto his thighs. The stretch is felt in the back, shoulders, and lower back. The elevated hand placement adds to the stretch.

Figure 35A:
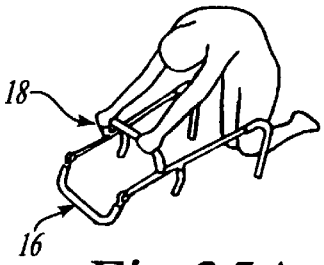
Figure 35B:
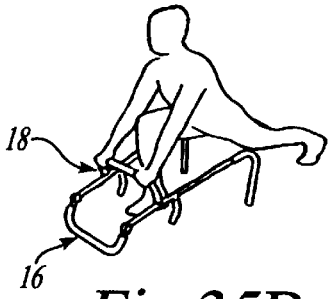

FIG. 35A and FIG. 35B show how the apparatus 10 may be used to do an exercise for back care. The apparatus 10 is positioned as in FIG. 32. The top crosspiece 16 is adjusted halfway forward. Facing the lower crosspiece 18, the user kneels an arm's length away from the lower crosspiece 18 and grasps the lower crosspiece 18. The user may flex (FIG. 35A) and extend (FIG. 35B) his spine. The elevated hand placement eases the extreme position of the wrists.

Figure 36:
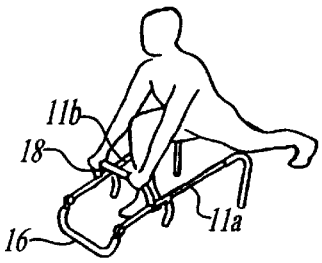

FIG. 36 shows how the apparatus 10 may be used to effect a stretch in the psoas muscle and other hip flexor muscles. The apparatus 10 is positioned as in FIG. 32. The top crosspiece 16 is adjusted halfway forward. Standing within the legs 11*a*, 11*b* of the apparatus 10 and facing the lower crosspiece 18, the user bends over to grasp the lower crosspiece 18, with his hands a shoulder's width apart. The user extends one leg behind and keeps the forward knee bent at ninety degrees. Bracing with the hands and the back foot, driving the heel to the floor, the user can effect a stretch to the hip flexors. The elevated hand placement and bracing provide the user with balance and leverage, while the apparatus 10 provides a stable frame of support.

Figure 37A:
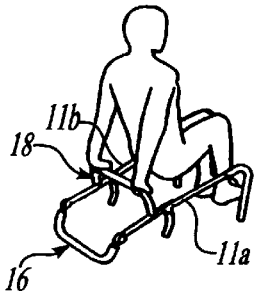
Figure 37B:
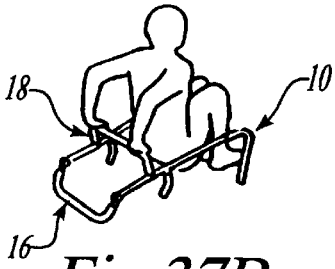

FIG. 37A and FIG. 37B show how the apparatus 10 may be used to strengthen the arms in a common exercise known as dips. The apparatus 10 is positioned as in FIG. 32. The top crosspiece 16 is adjusted halfway forward. Standing within the legs 11*a*, 11*b* and facing the open end of the apparatus 10, the user grasps the lower crosspiece 18 with both hands a shoulder's width apart. Feet are positioned at a distance from the lower crosspiece 18 which allows the knees to stay above the ankles. The user is able to adjust the amount of his weight he is lifting with his arms by using his legs to lift more or less of his weight.

Figure 38:
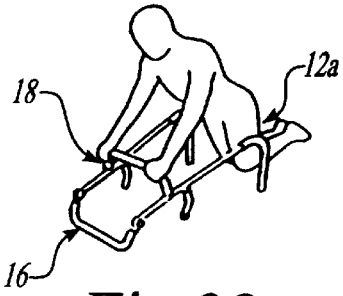
Figure 39:
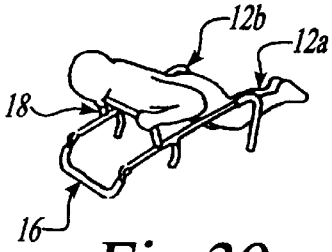

FIGS. 38 and 39 show how the apparatus 10 may be used to adapt a pushup for users with beginning strength levels. The apparatus 10 is positioned as in FIG. 32. The top crosspiece 16 is adjusted halfway forward. From a kneeling position (FIG. 38), between the rocker portions 12*a*, 12*b*, the user positions his hands on the lower crosspiece 18, a shoulder's width apart. The user then lowers himself to touch the lower crosspiece 18 with his chest (FIG. 39). Being on an elevated support lessens the amount of weight the user is lifting. The padded grip and wrist position also lessen the wrist strength necessary to perform this exercise.

Figure 40A:
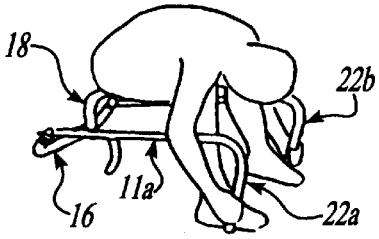
Figure 40B:
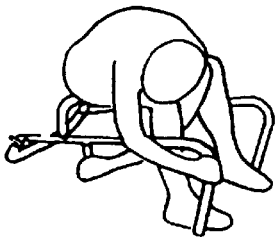

FIG. 40A and FIG. 40B show how the apparatus 10 may be used to stretch the lower back. FIG. 40B shows an alternate hand position, and, thus, a different emphasis of stretch from FIG. 40A. The following refers to FIG. 40A. The apparatus 10 is positioned as in FIG. 32. The top crosspiece 16 is adjusted halfway forward. The user sits on the lower crosspiece 18, braces his bent legs against the legs 11*a*, 11*b* of the apparatus 10, and reaches his hands forward to grasp the straight distal ends 22*a*, 22*b*. He then bends his torso forward and through his legs to effect the low back stretch. The combination of a low seat height provided by the lower crosspiece 18, bracing the user's legs against the legs 11*a*, 11*b* of the apparatus 10, and grasping the straight distal ends 22*a*, 22*b*, allows the user to be well supported while stretching the back.

Figure 41:
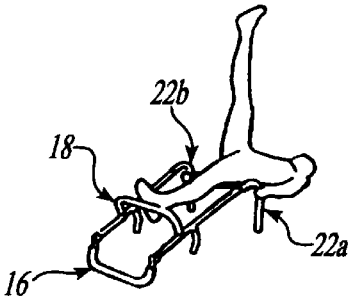

FIG. 41 shows how the apparatus 10 may be used to strengthen the gluteal and hamstring muscles. The apparatus 10 is positioned as in FIG. 32. The top crosspiece 16 is adjusted halfway forward. From a supine position the user places her hips between the rocker portions 12*a*, 12*b* while placing the sole of one foot against the lower surface of the lower crosspiece 18 and grasping the straight distal ends 22*a*, 22*b* with her hands. The unsupported leg is then raised vertically to the floor. This action causes the gluteal and hamstring muscles of the leg pushing against the lower crosspiece 18 to contract with great force, much more so than is possible on an open floor. The magnitude of the opposing forces in this configuration by the foot pushing away and by the hands preventing the apparatus 10 from moving, respectively, permits the user to attain a much higher arc position than would be otherwise possible.

Figure 42:
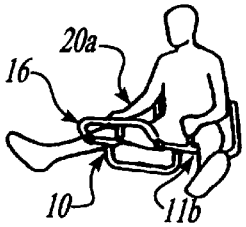

FIG. 42 shows how the apparatus 10 may be used to effect a stretch of the hip adductors, hamstrings, and lower back muscles in a manner similar to that described in FIG. 25, but for a less advanced user. The apparatus 10 is positioned parallel to the floor with the handgrips 20*a*, 20*b* facing upward. Adjustment of the top crosspiece 16 is not required. The user sits spread-legged (straddled) with the thighs placed over the legs 11*a*, 11*b* of the apparatus 10. The user may grasp either the handgrips 20*a*, 20*b*, or anywhere else along the apparatus 10 to effect the desired stretch. The variance of hand position allows the user to select the desired degree of stretch.

Figure 43:
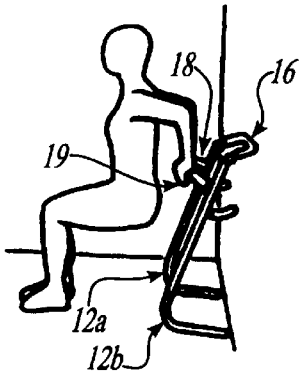

FIG. 43 shows how the apparatus 10 may be used to perform a beginner's version of the exercise mentioned in FIG. 37, commonly known as dips. The top crosspiece 16 is adjusted halfway forward and the apparatus 10 is positioned against a wall with the top crosspiece 16 contacting the wall. The user stands with his feet half a stride away from the rocker portions 12*a*, 12*b* facing away from the apparatus 10. While grasping the lower crosspiece 18, the user uses his legs to assist the arms in lowering and raising his body. The height of the lower crosspiece 18, comfort of the pad 19, and stability of the apparatus 10 allow even a very deconditioned beginner to perform this exercise to a satisfying extent.

Figure 44:
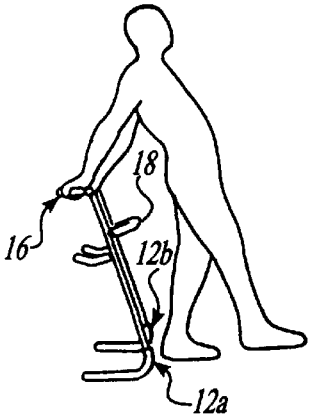

FIG. 44 shows how the apparatus 10 may be used to stretch the muscles of the chest and arms. The apparatus 10 is disposed vertically. Adjustment of either crosspiece, 16 or 18, is not critical. The user stands with one leg forward and one leg back, facing away from the apparatus 10, on the lower crosspiece 18 side. The user reaches behind himself to grasp the top crosspiece 16 with both hands, tilting the apparatus 10 toward the user to do so. The user then extends his elbow joints and rocks the apparatus 10 away until the desired level of stretch is reached. Multiple hand positions can be employed to emphasize different body parts. The smooth, exact adjustment provided by the rocker portions 12*a*, 12*b* allows the user a safe, controlled stretch.

Figure 45:
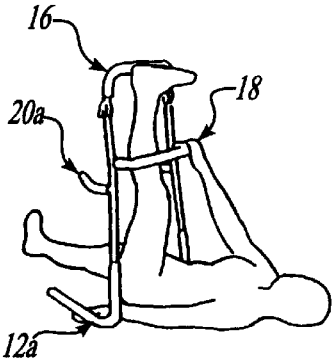

FIG. 45 shows how the apparatus 10 may be used to perform a similar but more advanced version of the hamstring stretch shown in FIG. 1. With the top crosspiece 16 adjusted upward, the apparatus 10 is positioned vertically. The user positions himself supine, but facing the lower crosspiece 18 instead of the handgrips 20*a*, 20*b*, and with the hip joint axis closely corresponding to the axis of the rocker portions 12*a*, 12*b*. While grasping the lower crosspiece 18, the user places the heel of the foot of the leg to be stretched on the top crosspiece 16, allowing the shin of said leg to contact the lower crosspiece 18 so that the knee of said leg is extended by moving the axis of the rocker portions 12*a*, 12*b* either forward or rearward. The user then pulls the lower crosspiece 18 toward his head to deepen the stretch. The locking action of the apparatus 10 on the knee of the upraised leg, combined with the rocker action of the rocker portions 12*a*, 12*b*, allows an especially stable stretch in which the user may relax almost fully.

Figure 46:
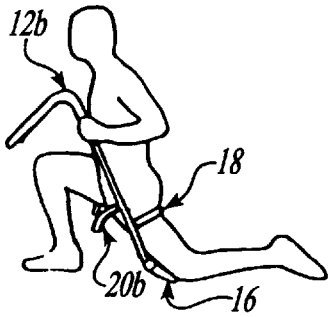

FIG. 46 shows how the apparatus 10 may be used to stretch the hip flexor muscles. The top crosspiece 16 is adjusted half rearward. The standing user rotates the apparatus 10 so that the top crosspiece 16 rests on the floor with the handgrips 20*a*, 20*b* facing away from the user. The user then places one leg through the gap between the top crosspiece 16 and the lower crosspiece 18 so that the user assumes a kneeling position with the lower crosspiece 18 resting on the gluteal fold (where the buttocks become the posterior thigh) and the top crosspiece 16 resting against the front of the knee of the leg to be stretched. The user then grasps the rocker portions 12*a*, 12*b* and pushes them toward the floor to deepen the stretch. The combination of restraint of the lower end of the user's pelvis, provided by the lower crosspiece 18, the fulcrum provided by the top crosspiece 16, and the ample leverage provided by the length of the apparatus 10, allows the user to apply a carefully metered stretch to the hip flexor muscles without also applying an undesirable load to the lower back.

Figure 47:
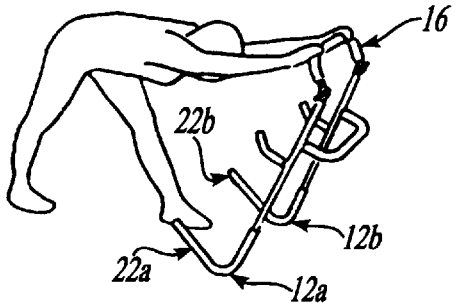

FIG. 47 shows how the apparatus 10 may be used to stretch the hamstrings, torso and shoulders. The top crosspiece 16 is adjusted half forward. The user stands, in a stride stance, facing the handgrip side of the apparatus 10, with the front foot aligned approximately with the straight distal ends 22*a*, 22*b*. Grasping the top crosspiece 16, the user then pushes the top crosspiece 16 away to obtain the desired level of stretch. The rocking action of the rocker portions 12*a*, 12*b* allows for a controlled stretch, while the apparatus 10 stabilizes this movement.

Figure 48:
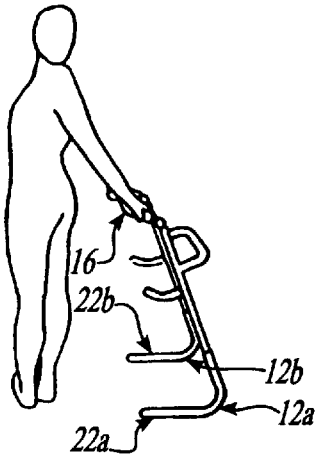

FIG. 48 shows how the apparatus 10 may be used to stretch the torso, chest, shoulders and arms. The top crosspiece 16 is adjusted half forward. The user stands approximately one foot from the straight distal ends 22*a*, 22*b* with the feet perpendicular to the straight distal ends 22*a*, 22*b*. The outside hand reaches behind the torso to grasp the top crosspiece 16 while the inner hand grasps the top crosspiece 16 at the opposing end. The user rotates the torso with the assistance of the pull and push of the hands against the top crosspiece 16 to effect the stretch of the muscle groups. The rocking action of the rocker portions 12*a*, 12*b* allows for a controlled stretch, while the apparatus 10 stabilizes this movement.

Figure 49:
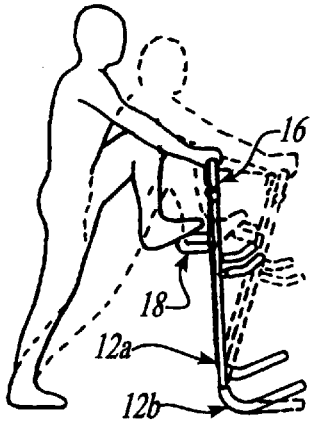

FIG. 49 shows how the apparatus 10 may be used to perform a standing stretch of the hip flexor and extensor muscles. The apparatus 10 is positioned vertically and the top crosspiece 16 is adjusted halfway rearward for a beginner, upward for an intermediate, and halfway forward for an advanced user. Adjustment of the lower crosspiece 18 is downward for a beginner, neutral for an intermediate, and upward for an advanced user. While standing half a stride from the apparatus 10 facing the lower crosspiece 18 side, the user grasps the top crosspiece 16 and rocks the apparatus 10 toward himself to lower the crosspiece 18. The user then steps up to place a selected foot on the lower crosspiece 18 and pushes the top crosspiece 16 away which raises the lower crosspiece 18 to the desired level of stretch. The levered rocking action of the apparatus 10 permits an extremely precise and controllable height adjustment of the lower crosspiece 18, while the tripod of the user's support foot and the rocker portions 12*a*, 12*b* provides enough stability to allow the user to relax into the stretch. Additionally, the conveniences of a standing position and stretching several muscle groups at once, combined with the aforementioned microadjustability aspect of the exercise, give significant advantages over other techniques.

Figure 50A:
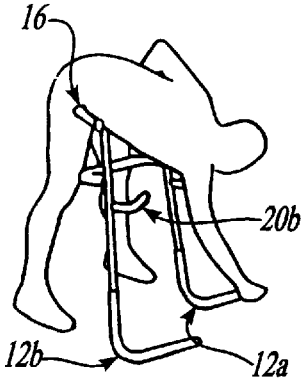
Figure 50B:
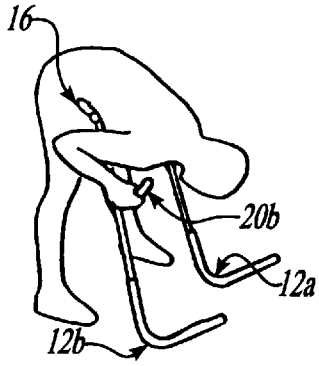

FIG. 50A and 50B show how the apparatus 10 may be used to stretch the low back and torso. The top crosspiece 16 is adjusted in the half rearward position. The user stands facing the top crosspiece 16 with his feet apart approximately the distance between the rocker portions 12*a*, 12*b*. The user holds the apparatus 10 on its rocker portions 12*a*, 12*b* while placing the top crosspiece 16 in the fold of the hip. Bending over the top crosspiece 16 to grasp the handgrips 20*a*, 20*b*, the user effects a stretch in the low back (FIG. 50B). The user may vary the location of the stretch by adjusting the hand positions. With one hand on the top crosspiece 16 and the other hand on the same side straight distal end, the user is able to add a stretch of the torso (FIG. 50A).

Figure 51:
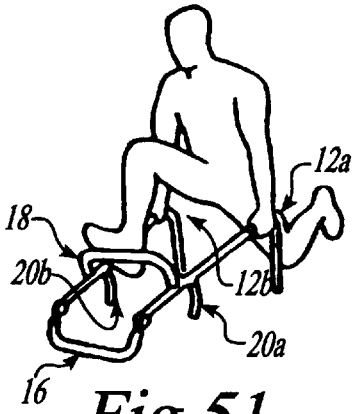

FIG. 51 shows how the apparatus 10 may be used to effect a unique stretch of major muscles used in running, the hamstrings, quadriceps, and other hip flexor and extensor groups. The top crosspiece 16 is adjusted halfway forward. The lower crosspiece 18 is adjusted neutrally. The apparatus 10 is positioned parallel to the floor with the handgrips 20*a*, 20*b* facing toward the floor. The user stands between the rocker portions 12*a*, 12*b*, facing the lower crosspiece 18. The user then grasps the rocker portions 12*a*, 12*b* while kneeling with one leg and placing the sole of the foot of the other leg on the lower crosspiece 18. The elevated foot placement and handgrips provided by the apparatus 10 greatly reduce the strain on the user's wrists and knee compared to traditional versions of this move performed with less than all the aforementioned assists.

While the preferred embodiments of the invention have been illustrated and described, it will be appreciated that various changes can be made therein without departing from the spirit and scope of the invention.

What is claimed is:

1. A stretching and exercise apparatus comprising:

a pair of generally parallel legs spaced apart from each other, the legs having first ends and second ends, each leg defining a longitudinal length, the first end of each leg being connected to a free distal end extension defining an extension length by a ground-engaging arcuate rocker portion, the longitudinal length of each leg being in excess of twice the extension length;

a first crosspiece oriented transversely across the legs and having first and second ends attached to the legs proximate the second ends of the legs, wherein the first crosspiece and the legs are adjustable relative to each other to accommodate the extended length of a user's leg between the first crosspiece and the leg end extensions; and a pair of handgrips defined on the legs between the second ends and the rocker portions.

2. The stretching and exercise apparatus of claim 1, which further includes a second crosspiece oriented transversely across the legs and having first and second ends attached to the legs between the second ends and the handgrips.

3. The stretching and exercise apparatus of claim 2, wherein the first and second crosspieces are oriented generally perpendicularly relative to the legs, the legs being in parallel disposition.

4. The stretching and exercise apparatus of claim 2, wherein the second crosspiece defines generally a U shape.

5. The stretching and exercise apparatus of claim 2, wherein the second crosspiece is selectively slidably attached to the legs.

6. The stretching and exercise apparatus of claim 2, wherein the first and second crosspieces are at least partially covered with a pad.

7. The stretching and exercise apparatus of claim 1, wherein the rocker portions define a pivot axis that generally coincides with a hip pivot axis of a person lying therebetween in a supine position.

8. The stretching and exercise apparatus of claim 1, wherein the distal ends of the rocker portions have a substantially straight section projecting generally perpendicularly from the legs.

9. The stretching and exercise apparatus of claim 8, wherein the straight section of the distal ends define approximately a 60° to 80° angle relative to the legs.

10. The stretching and exercise apparatus of claim 1, wherein the first crosspiece defines a U shape.

11. The stretching and exercise apparatus of claim 10, wherein the first crosspiece is selectively pivotally attached to the second ends of the legs.

12. The stretching and exercise apparatus of claim 1, wherein the handgrips comprise first and second handgrip members secured to corresponding legs.

13. The stretching and exercise apparatus of claim 12, wherein the handgrips members are selectively slidably secured to the legs.

14. The stretching and exercise apparatus of claim 13, further comprising a second U-shaped crosspiece attached to the legs opposite of the handgrip members.

15. The stretching and exercise apparatus of claim 1, further comprising a timer attached to the apparatus for monitoring a time period and a signal generator operative in response to the timer.

16. The stretching and exercise apparatus of claim 1, wherein the handgrips are integrally defined by a portion of the legs.

17. The stretching and exercise apparatus of claim 1, wherein the pair of legs are generally S-shaped, each leg including a curved portion approximately midway along the length of the leg for defining the handgrip.

18. The stretching and exercise apparatus of claim 17, which further includes a second crosspiece oriented transversely across the legs and having first and second ends attached to the legs between the second ends and the curved portions.

19. The stretching and exercise apparatus of claim 17, wherein the pair of legs and the first crosspiece are formed integrally to define an elongate U-shaped frame.

20. A stretching and exercise apparatus comprising:

a pair of generally parallel legs spaced apart from each other, the legs having first ends and second ends, each leg defining a longitudinal length, the first ends being connected to a free distal end extension defining an extension length by a rocker portion adapted for rocking the leg in a first plane defined generally perpendicular to a second plane defined cooperatively by the pair of legs, the longitudinal length of each leg being in excess of twice the extension length;

a first crosspiece oriented transversely across the legs and having first and second ends attached to the legs proximate the second ends of the legs, wherein the first crosspiece and legs are adjustable relative to each other to accommodate the extended length of a user's leg between the first crosspiece and leg distal end extensions; and a pair of handgrips defined on the legs between the second ends and the rocker portions.

21. The stretching and exercise apparatus of claim 20, wherein the distal end extensions comprise ground-engaging stands pivotally supporting the first ends of the legs.

22. The stretching and exercise apparatus of claim 20, wherein the distal end extensions comprise arcuate rocker segments of the legs.

23. A stretching and exercise apparatus comprising:

a pair of generally parallel legs spaced apart from each other, the legs having first ends and second ends, each leg defining a longitudinal length the first end of each leg being connected to a free distal end extension defining an extension length by a ground-engaging arcuate rocker portion defining a radius of approximately 3 inches, the longitudinal length of each leg being in excess of twice the extension length;

a first crosspiece oriented transversely across the legs and having first and second ends attached to the legs proximate the second ends of the legs, wherein the first crosspiece and the legs are adjustable relative to each other to accommodate the extended length of a user's leg between the first crosspiece and the leg end extensions; and a pair of handgrips defined on the legs between the second ends and the rocker portions.

24. A stretching and exercise apparatus comprising:

a pair of generally parallel legs spaced apart from each other, the legs each defining a longitudinal length having first ends and second ends, the first end of each leg being connected to a free distal end extension defining an extension length by a ground-engaging arcuate rocker portion, the free distal end extension defining an angle with respect to the leg of approximately 60 to less than 90 degrees, the longitudinal length of each leg being in excess of twice the extension length;

a first crosspiece oriented transversely across the legs and having first and second ends attached to the legs proximate the second ends of the legs, wherein the first crosspiece and the legs are adjustable relative to each other to accommodate the extended length of a user's leg between the first crosspiece and the leg end extensions; and a pair of handgrips defined on the legs between the second ends and the rocker portions.

* * * * *

UNITED STATES PATENT AND TRADEMARK OFFICE

CERTIFICATE OF CORRECTION

PATENT NO. : 6,203,473 B1
DATED : March 20, 2001
INVENTOR(S) : D.F. Atwood

It is certified that error appears in the above-identified patent and that said Letters Patent is hereby corrected as shown below:

Title page,
Item [56], References Cited, (U.S. PATENT DOCUMENTS), insert in appropriate numerical order the following:

| | | |
|---|---|---|
| -- 2,644,688 | 7/1953 | Roberge |
| 3,540,724 | 11/1970 | Hunter |
| 3,782,717 | 1/1974 | Berlin |
| 3,920,240 | 11/1975 | Ross |
| 4,101,124 | 7/1978 | Mahnke |
| 4,826,158 | 5/1989 | Fields, Jr. |
| 4,844,454 | 7/1989 | Rogers |
| 4,848,742 | 7/1989 | Lindley et al. |
| 4,850,589 | 7/1989 | Block |
| 4,902,003 | 2/1990 | Buoni |
| 4,932,653 | 6/1990 | Schwartz et al. |
| 5,074,549 | 12/1991 | Harvey |
| 5,096,187 | 3/1992 | Marples |
| 5,122,106 | 6/1992 | Atwood et al. |
| 5,147,266 | 9/1992 | Ricard |
| 5,169,362 | 12/1992 | Schwartz |
| 5,232,427 | 8/1993 | Paro |
| 5,236,333 | 8/1993 | Barba, Jr. |
| 5,290,209 | 3/1994 | Wilkinson |
| 5,302,164 | 4/1994 | Austin |
| 5,316,527 | 5/1994 | Lekhtman |
| 5,356,362 | 10/1994 | Becker et al. |
| 5,405,306 | 4/1995 | Goldsmith et al. |
| 5,536,229 | 7/1996 | Albergo |
| 5.492,520 | 2/1996 | Brown |
| 5,538,487 | 7/1996 | Fulmer -- |

UNITED STATES PATENT AND TRADEMARK OFFICE

CERTIFICATE OF CORRECTION

PATENT NO. : 6,203,473 B1
DATED : March 20, 2001
INVENTOR(S) : D.F. Atwood

It is certified that error appears in the above-identified patent and that said Letters Patent is hereby corrected as shown below:

Item [56], References Cited, (U.S. PATENT DOCUMENTS), insert in appropriate numerical order the following:

| | | |
|---|---|---|
| 3,540,724 | 11/1970 | Hunter |
| 5,096,187 | 3/1992 | Marples |
| 4,638,995 | 1/1987 | Wilson |
| 3,857,561 | 12/1974 | Cecchettini |
| 3,679,203 | 7/1972 | Grana |
| 5,842,960 | 12/1998 | Yu |
| 5,536,222 | 7/1996 | Banda |
| 5,779,607 | 7/1998 | Harris |
| 5,261,868 | 11/1993 | Pryor |
| 5,203,755 | 4/1993 | Kaiser |
| 4,611,806 | 9/1986 | Terry |
| 4,232,868 | 11/1980 | Roach |
| 4,133,524 | 1/1979 | Barlew |
| 5,518,485 | 5/1996 | Zislis |
| 5,403,258 | 4/1995 | Hill -- |

Column 21,
Line 35, "rocker" should read -- ground-engaging --

Signed and Sealed this

Ninth Day of July, 2002

*Attest:*

*Attesting Officer*

JAMES E. ROGAN
*Director of the United States Patent and Trademark Office*